US011801693B2

(12) United States Patent
Knausdorf et al.

(10) Patent No.: US 11,801,693 B2
(45) Date of Patent: Oct. 31, 2023

(54) AIRFLOW CONTROL IN A PRINTING SYSTEM USING A MOVABLE BAFFLE, AND RELATED DEVICES, SYSTEMS, AND METHODS

(71) Applicant: XEROX CORPORATION, Norwalk, CT (US)

(72) Inventors: Peter John Knausdorf, Henrietta, NY (US); Anthony Salvatore Condello, Webster, NY (US); Jack T. Lestrange, Macedon, NY (US); Palghat S. Ramesh, Pittsford, NY (US); Joseph C. Sheflin, Macedon, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 17/217,388

(22) Filed: Mar. 30, 2021

(65) Prior Publication Data

US 2022/0314647 A1 Oct. 6, 2022

(51) Int. Cl.
*B41J 11/00* (2006.01)

(52) U.S. Cl.
CPC ..... *B41J 11/0085* (2013.01)

(58) Field of Classification Search
None
See application file for complete search history.

(56) References Cited

U.S. PATENT DOCUMENTS 8,388,246 B2 3/2013 Spence et al.
9,796,546 B1 10/2017 LeFevre et al.
(Continued)

FOREIGN PATENT DOCUMENTS

CN 104044366 A 9/2014
EP 1449668 A1 8/2004
(Continued)

OTHER PUBLICATIONS

Sugimoto, Recording Device, May 19, 2011, Japan, All (Year: 2011).*
(Continued)

*Primary Examiner* — Justin Seo
*Assistant Examiner* — Tracey M McMillion
(74) *Attorney, Agent, or Firm* — JONES ROBB PLLC

(57) ABSTRACT

A printing system comprises an ink deposition assembly, a media transport device, and an airflow control system. The ink deposition assembly comprises a printhead to eject ink through a carrier plate opening in a carrier plate. The media transport device holds a print medium against a movable support surface by vacuum suction and transports the print media through a deposition region. The airflow control system comprises a baffle that is movable between an upstream-blocking configuration and a downstream-blocking configuration, and an actuator configured to move the baffle. In the upstream-blocking configuration the baffle blocks airflow through an upstream side of the printhead opening while allowing airflow through a downstream side of the printhead opening. In the downstream-blocking configuration the baffle blocks airflow through the downstream side of the printhead opening while allowing airflow through the upstream side of the printhead opening.

20 Claims, 20 Drawing Sheets

(56) References Cited

U.S. PATENT DOCUMENTS

| | | | | |
|---|---|---|---|---|
| 9,815,303 | B1 * | 11/2017 | Herrmann | B41J 11/0085 |
| 9,944,094 | B1 * | 4/2018 | Herrmann | B41J 13/226 |
| 10,688,778 | B2 | 6/2020 | Fromm et al. | |
| 2002/0158937 | A1 * | 10/2002 | Pietrzyk | B41J 2/04 347/32 |
| 2010/0208018 | A1 | 8/2010 | Snyder et al. | |
| 2010/0276868 | A1 | 11/2010 | Moore et al. | |
| 2011/0248441 | A1 * | 10/2011 | Yamada | B41J 11/06 271/11 |
| 2013/0050375 | A1 | 2/2013 | Ishimori et al. | |
| 2016/0347091 | A1 | 12/2016 | Onuma et al. | |
| 2018/0339529 | A1 | 11/2018 | Zirilli | |
| 2020/0345545 | A1 | 11/2020 | Zhang | |
| 2021/0138803 | A1 | 5/2021 | Lefevre et al. | |

FOREIGN PATENT DOCUMENTS

| | | | |
|---|---|---|---|
| EP | 1449668 | B1 | 5/2007 |
| EP | 1 319 510 | B1 | 9/2009 |
| GB | 2 374 834 | A | 10/2002 |

OTHER PUBLICATIONS

Co-Pending U.S. Appl. No. 17/217,370, "Airflow Control Through Vacuum Platen of Printing System by a Movable Damper, and Related Devices, Systems, and Methods,", Mar. 30, 2021.

Co-Pending U.S. Appl. No. 17/217,399, "Devices, Systems, and Methods for Controlling Airflow Through Vacuum Platen of Printing System by a Movable Damper,", Mar. 30, 2021.

Co-Pending U.S. Appl. No. 17/217,411, "Devices, Systems, and Methods for Controlling Airflow Through Vacuum Platen of Printing System Via Airflow Zones,", Mar. 30, 2021.

Co-Pending U.S. Appl. No. 17/217,432, "Controlling Airflow Through Vacuum Platen of Printing System by a Movable Damper, and Related Devices, Systems, and Methods,", Mar. 30, 2021.

Co-Pending U.S. Appl. No. 17/217,448, "Devices, Systems, and Methods for Controlling Airflow Through Vacuum Platen of Printing System by Rotating Valve,", Mar. 30, 2021.

Co-Pending U.S. Appl. No. 17/217,466, "Airflow Control in a Printing System, and Related Devices, Systems, and Methods,", Mar. 30, 2021.

* cited by examiner

AIRFLOW CONTROL IN A PRINTING SYSTEM USING A MOVABLE BAFFLE, AND RELATED DEVICES, SYSTEMS, AND METHODS

FIELD

Aspects of this disclosure relate generally to inkjet printing, and more specifically to inkjet printing systems having a media transport device utilizing vacuum suction to hold and transport print media. Related devices, systems, and methods also are disclosed.

INTRODUCTION

In some applications, inkjet printing systems use an ink deposition assembly with one or more printheads, and a media transport device to move print media (e.g., a substrate such as sheets of paper, envelopes, or other substrate suitable for being printed with ink) through an ink deposition region of the ink deposition assembly (e.g., a region under the printheads). The inkjet printing system forms printed images on the print media by ejecting ink from the printheads onto the media as the media pass through the deposition region. In some inkjet printing systems, the media transport device utilizes vacuum suction to assist in holding the print media against a movable support surface (e.g., conveyor belt, rotating drum, etc.) of the transport device. Vacuum suction to hold the print media against the support surface can be achieved using a vacuum source (e.g., fans) and a vacuum plenum fluidically coupling the vacuum source to a side of the moving surface opposite from the side that supports the print medium. The vacuum source creates a vacuum state in the vacuum plenum, causing vacuum suction through holes in the movable support surface that are fluidically coupled to the vacuum plenum. When a print medium is introduced onto the movable support surface, the vacuum suction generates suction forces that hold the print medium against the movable support surface. The media transport device utilizing vacuum suction may allow print media to be securely held in place without slippage while being transported through the ink deposition region under the ink deposition assembly, thereby helping to ensure correct locating of the print media relative to the printheads and thus more accurate printed images. The vacuum suction may also allow print media to be held flat as it passes through the ink deposition region, which may also help to increase accuracy of printed images, as well as helping to prevent part of the print medium from rising up and striking part of the ink deposition assembly and potentially causing a jam or damage.

One problem that may arise in inkjet printing systems that include media transport devices utilizing vacuum suction is unintended blurring of images resulting from air currents induced by the vacuum suction. In some systems, such blurring may occur in portions of the printed image that are near the edges of the print media, particularly those portions that are near the lead edge or trail edge in the transport direction of the print media. During a print job, the print media are spaced apart from one another on the movable support surface as they are transported through the deposition region of the ink deposition assembly, and therefore parts of the movable support surface between adjacent print media are not covered by any print media. This region between adjacent print media is referred to herein as the inter-media zone. Thus, adjacent to both the lead edge and the trail edge of each print medium in the inter-media zone there are uncovered holes in the movable support surface. Because these holes are uncovered, the vacuum of the vacuum plenum induces air to flow through those uncovered holes. This airflow may deflect ink droplets as they are traveling from a printhead to the substrate, and thus cause blurring of the image.

A need exists to improve the accuracy of the placement of droplets in inkjet printing systems and to reduce the appearance of blur of the final printed media product. A need further exists to address the blurring issues in a reliable manner and while maintaining speeds of printing and transport to provide efficient inkjet printing systems.

SUMMARY

Embodiments of the present disclosure may solve one or more of the above-mentioned problems and/or may demonstrate one or more of the above-mentioned desirable features. Other features and/or advantages may become apparent from the description that follows.

In accordance with at least one embodiment of the present disclosure, a printing system comprises an ink deposition assembly, a media transport device, and an airflow control system. The ink deposition assembly comprises a carrier plate and a printhead arranged to eject a print fluid through a printhead opening in the carrier plate to a deposition region of the ink deposition assembly. The media transport device comprises a movable support surface and is configured to hold a print medium against the movable support surface by vacuum suction through holes in the media transport device and transport the print media along a process direction though the deposition region. The airflow control system comprises a baffle that is movable between an upstream-blocking configuration and a downstream-blocking configuration, and an actuator configured to move the baffle between the upstream-blocking configuration and the downstream-blocking configuration. In the upstream-blocking configuration the baffle blocks airflow through an upstream side of the printhead opening while allowing airflow through a downstream side of the printhead opening, upstream and downstream being defined based on the process direction. In the downstream-blocking configuration the baffle blocks airflow through the downstream side of the printhead opening while allowing airflow through the upstream side of the printhead opening.

In accordance with at least one embodiment of the present disclosure, a method comprises transporting a print medium in a process direction through a deposition region of a printhead of the printing system. The print medium is held during the transporting against a moving support surface of a media transport device via vacuum suction through holes in the media transport device. The method further comprises ejecting print fluid from the printhead through a printhead opening in a carrier plate to deposit the print fluid to the print medium in the deposition region. The method further comprises controlling an airflow control system to selectively block an upstream side of the printhead opening and a downstream side of the printhead opening by moving a baffle between an upstream-blocking configuration in which the baffle blocks the upstream side of the printhead opening and a downstream-blocking configuration in which the baffle blocks a downstream side of the printhead opening, wherein upstream and downstream are defined based on the process direction.

BRIEF DESCRIPTION OF THE DRAWINGS

The present disclosure can be understood from the following detailed description, either alone or together with the accompanying drawings. The drawings are included to provide a further understanding of the present disclosure and are incorporated in and constitute a part of this specification. The drawings illustrate one or more embodiments of the present teachings and together with the description explain certain principles and operation. In the drawings.

DETAILED DESCRIPTION

Figure 1A:
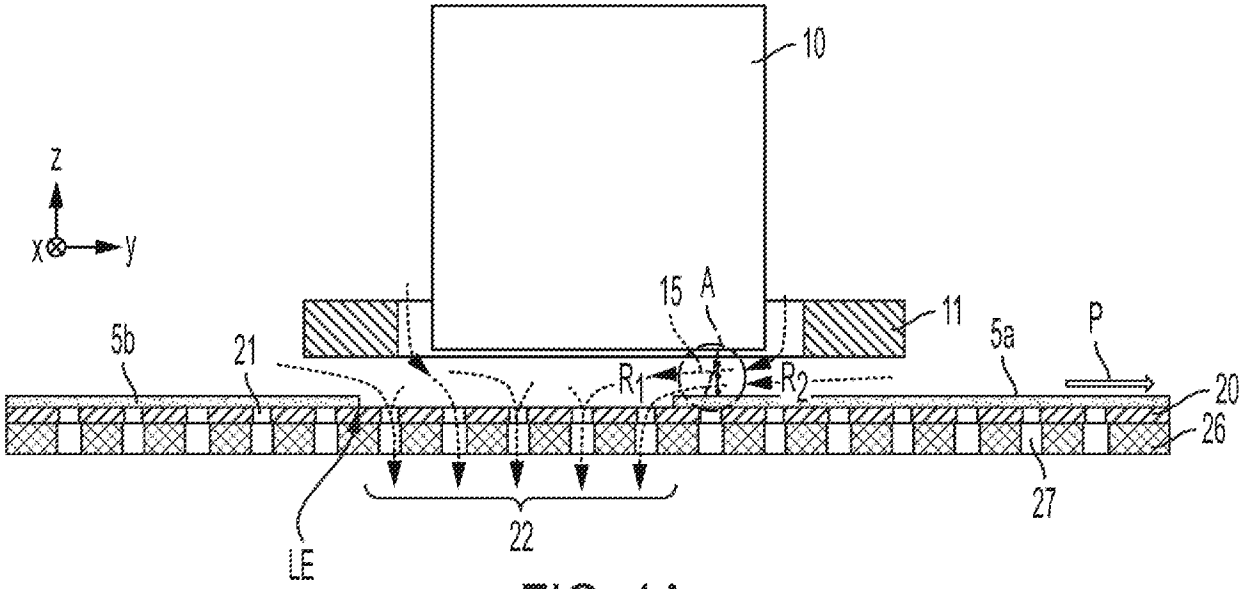
FIG. 1A RELATED ART
FIGS. 1A-1I schematically illustrate air flow patterns relative to a printhead assembly, transport device, and print media during differing stages of print media transport through an ink deposition region of a conventional inkjet printing system, and resulting blur effects in the printed media product.
Figure 1C:
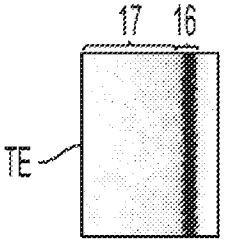
Figure 1B:
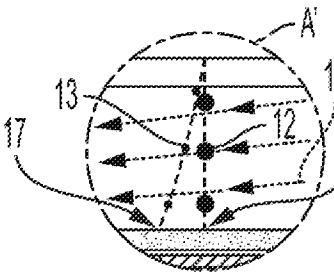
Figure 1D:
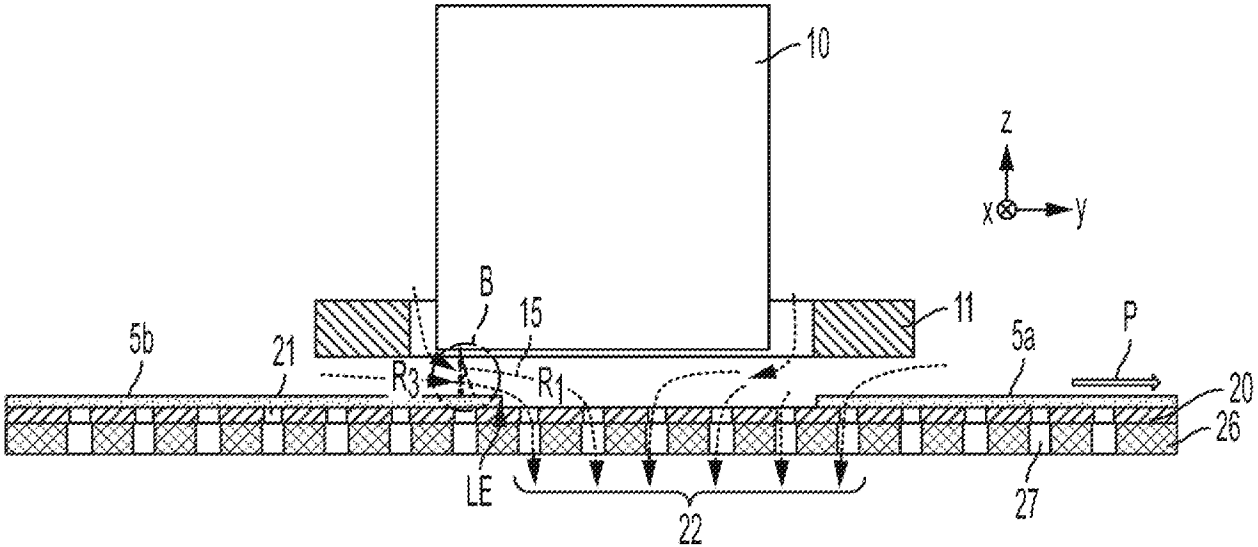
FIG. 1D RELATED ART
Figure 1F:
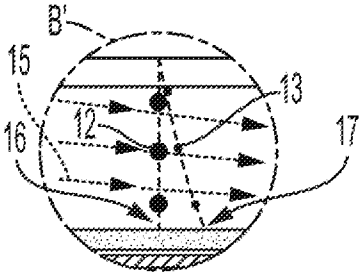
Figure 1E:
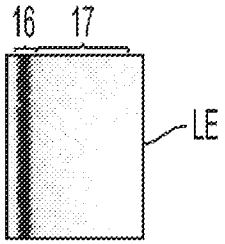
Figure 1G:
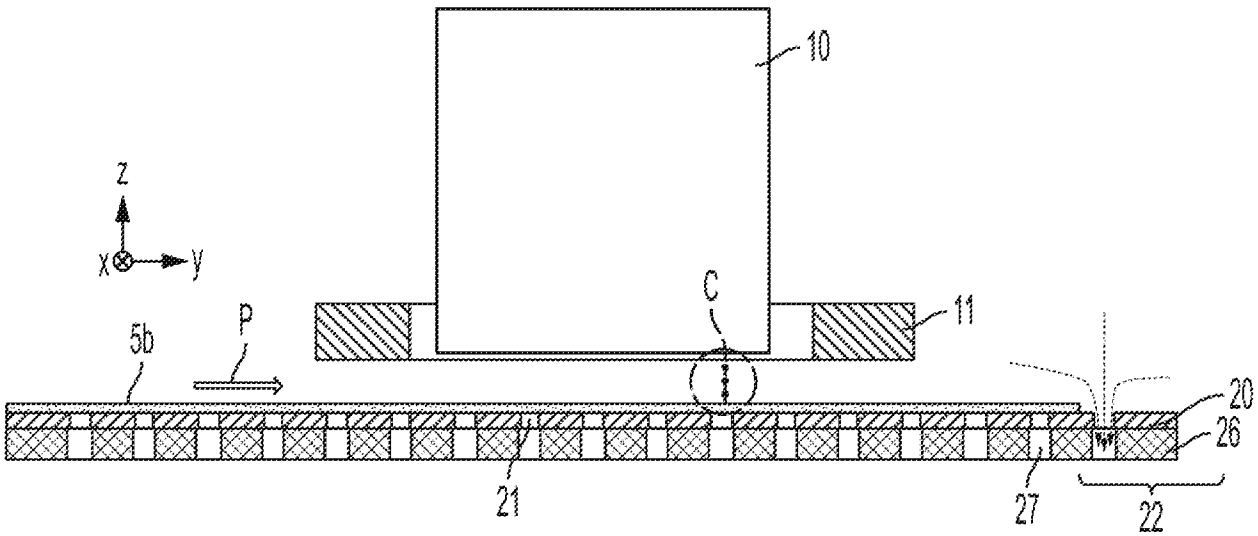
FIG. 1G RELATED ART
Figure 1I:
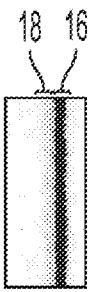
Figure 1H:
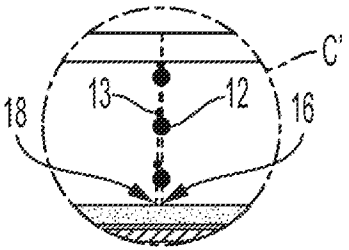

As described above, when an inter-media zone is near or under a printhead, the uncovered holes in the inter-media zone can create crossflows that can blow satellite droplets off course and cause image blur. To better illustrate some of the phenomena occurring giving rise to the blurring issues, reference is made to FIGS. 1A-1I. FIGS. 1A, 1D, and 1G illustrate schematically a printhead 10 printing on a print medium 5 near a trail edge TE, a lead edge LE, and a middle, respectively, of the print medium 5. FIGS. 1B, 1E, and 1H illustrate enlarged views of the regions A, B, and C, respectively. FIGS. 1C, 1F, and 1I illustrate enlarged pictures of printed images, the printed images comprising lines printed near the trail edge TE, lead edge LE, and middle, respectively, of a sheet of paper.

As shown in FIGS. 1A, 1D, and 1G, the inkjet printing system comprises a printhead 10 to eject ink through an opening in a carrier plate 11 to a print medium 5, and a movable support surface 20 that transports the print media 5 in a process direction P, which corresponds to a positive y-axis direction in the Figures. The movable support surface 20 is moveable (e.g., slides) along a top of a vacuum platen 26, and a vacuum environment is provided on a bottom side of the platen 26. The movable support surface 20 has holes 21 and the vacuum platen 26 has holes 27, and the holes 21 and 27 periodically align as the movable support surface 20 moves so as to expose the region above the movable support surface 20 to the vacuum below the platen 26. In regions where the print medium 5 covers the holes 21, the vacuum suction through the aligned holes 21 and 27 generates a force that holds the print medium 5 against the movable support surface 20. However, little or no air flows through these covered holes 21 and 27 since they are blocked by the print medium 5. On the other hand, as shown in FIGS. 1A and 1D, in the inter-media zone 22 the holes 21 and 27 are not covered by the print media 5, and therefore the vacuum suction pulls air to flow down through the holes 21 and 27 in the inter-media zone 22. This creates airflows, indicated by the dashed arrows in FIGS. 1A and 1D, which flow from regions around the printhead 10 towards the uncovered holes 21 and 27 in the inter-media zone 22, with some of the airflows passing under the printhead 10.

In FIG. 1A, the print medium 5*a* is being printed on near its trail edge TE, and therefore the region where ink is currently being ejected ("ink-ejection region") (e.g., region A in FIG. 1A) is located downstream of the inter-media zone 22 (upstream and downstream being defined with respect to the process direction P). Accordingly, some of the air being sucked towards the inter-media zone 22 will flow upstream through the ink-ejection region. More specifically, the vacuum suction from the inter-media zone 22 lowers the pressure in the region immediately above the inter-media zone 22, e.g., region $R_1$ in FIG. 1A, while the region downstream of the printhead 10, e.g., region $R_2$ in FIG. 1A, remains at a higher pressure. This pressure gradient causes air to flow in an upstream direction from the region $R_2$ to the region $R_1$, with the airflows crossing through the ink-ejection region (e.g., region A in FIG. 1A) which is between the regions $R_1$ and $R_2$. Some of this air may be pulled from the gap 19*d* between the downstream face of the printhead 10 and a rim of the opening through which the printhead 10 ejects ink. Airflows such as these, which cross through the ink-ejection region, are referred to herein as crossflows 15. In FIG. 1A, the crossflows 15 flow upstream, but in other situations the crossflows 15 may flow in different directions.

As shown in the enlarged view A' in FIG. 1B, which comprises an enlarged view of the region A, as ink is ejected from the printhead 10 towards the medium 5, main droplets 12 and satellite droplets 13 are formed. The satellite droplets 13 are much smaller than the main droplets 12 and have less mass and momentum, and thus the upstream crossflows 15*a* tend to affect the satellite droplets 13 more than the main droplets 12. Thus, while the main droplets 12 may land on the print medium 5 near their intended deposition location 16 regardless of the crossflows 15, the crossflows 15 may push the satellite droplets 13 away from the intended trajectory so that they land at an unintended location 17 on the medium 5, the unintended location 17 being displaced from the intended location 16. This can be seen in the actual printed image in FIG. 1C, in which the denser/darker line-shaped portion is formed by the main droplets 12 which were deposited predominantly at their intended locations 16, whereas the smaller dots dispersed away from the line are formed by satellite droplets 13 which were blown away from the intended locations 16 to land in unintended locations 17, resulting in a blurred or smudged appearance for the printed line. Notably, the blurring in FIG. 1C is asymmetrically biased towards the trail edge TE, due to the crossflows 15 near the trail edge TE blowing primarily in an upstream direction. The inter-media zone 22 may also induce other airflows flowing in other directions, such as downstream airflows from an upstream side of the printhead 10, but these other airflows do not pass through the region where ink is currently being ejected in the illustrated scenario and thus do not contribute to image blur. Only those airflows that cross through the ink ejection region are referred to herein as crossflows.

FIGS. 1D-1F illustrate another example of such blurring occurring, but this time near the lead edge LE of the print medium 5*b*. The cause of blurring near the lead edge LE as shown in FIGS. 1C and 1D is similar to that described above in relation to the trail edge TE, except that in the case of printing near the lead edge LE the ink-ejection region is now located upstream of the inter-media zone 22. As a result, the crossflows 15 that are crossing through the ink-ejection region now originate from the upstream side of the printhead 10, e.g., from region $R_3$, and flow downstream. For example, air may be pulled from the gap between the upstream face of the printhead 10 and the rim of the carrier plate opening. Thus, as shown in the enlarged view B' of FIG. 1E, which comprises an enlarged view of the region B, in the case of printing near the lead edge LE, the satellite droplets 13 are blown downstream towards the lead edge LE of the print medium 5*b* (positive y-axis direction). As shown in FIG. 1F, this results in asymmetric blurring that is biased towards the lead edge LE.

In contrast, as shown in FIG. 1H and the enlarged view C' in FIG. 1H, which corresponds to an enlarged view of region C, farther from the edges of the print media 105 there may be little or no crossflows 15 because the inter-media zone 22 is too distant to induce much airflow. Because the crossflows 15 are absent or weak farther away from the edges of the print medium 5, the satellite droplets 13 in this region are not as likely to be blown off course. Thus, as shown in FIGS. 1H and 1I, when printing farther from the edges of the print medium 5*b*, the satellite droplets land at locations 18 that are much closer to the intended locations 16 resulting in much less image blurring. The deposition locations 18 of the satellite droplets may still vary somewhat from the intended locations 16, due to other factors affecting the satellite droplets 13, but the deviation is smaller than it would be near the lead or trail edges.

Embodiments disclosed herein may, among other things, reduce or eliminate such image blur by utilizing an airflow control system that reduces or eliminates the crossflows. With the crossflows reduced or eliminated, all the droplets ejected from a printhead (including, e.g., the satellite droplets) are more likely to land closer to or at their intended deposition locations, and therefore the amount of blur is reduced. Airflow control systems in accordance with various embodiments reduce or eliminate the crossflows by selectively blocking airflow through upstream and downstream portions of the printhead openings in carrier plates. Such selective blocking can be synchronized, for example, based on the position of an inter-media zone. In various embodiments, one or more movable baffles are positioned around the printhead openings and each is configured to be movable between a configuration in which it blocks airflow through an upstream-side of the corresponding printhead opening(s) ("upstream-blocking configuration") and a configuration in which it blocks airflow through a downstream-side of the corresponding printhead opening(s) ("downstream-blocking configuration"). The timings at which the baffles are moved between the upstream-blocking and downstream-blocking configurations may be controlled based on the location of the inter-media zone such that the baffles block allow airflow through the side of the printhead opening that would tend to contribute to crossflows under the current circumstances, while allowing air to flow through the other side of the printhead opening to relieve the low pressure above the inter-media zone. The side of the printhead opening that will tend to contribute to crossflows changes as the inter-media zone moves past the printhead module, and therefore the baffles are moved between the upstream-blocking and downstream-blocking configurations based on the position of the inter-media zone to account for this. For example, when the downstream edge of the inter-media zone is under a printhead, such as in FIG. 1A, airflow through the downstream side of the corresponding carrier plate opening will tend to contribute to crossflows, as this airflow will tend to flow upstream through the deposition region where ink is being ejected. On the other hand, in this situation airflow through the upstream side of the printhead opening will actually help to somewhat alleviate crossflows because it will help to counteract the negative pressure above the inter-media zone. Thus, to prevent the crossflows from the downstream side of the printhead opening while allowing the beneficial airflow through the upstream side of the printhead opening, the baffle associated with the carrier plate opening is placed in the downstream-blocking configuration. However, as the inter-media zone continues to move downstream, eventually an upstream edge of the inter-media zone will start to pass under the printhead, such as in FIG. 1D, and at this point the upstream side of the printhead opening becomes the side that contributes to crossflows, while airflow through the downstream side is beneficial. Accordingly, the baffle is moved to the upstream-blocking configuration. Thus, the baffles reduce or eliminate crossflows by both blocking at least some airflows that would become crossflows while also allowing other airflows that help to mitigate crossflows. With the crossflows reduced or eliminated, the satellite droplets are more likely to land at or nearer to their intended deposition locations, and therefore the amount of blur is reduced. In addition, because countermeasures are being taken to reduce crossflows, if desired the amount of suction force generated by the vacuum source can be increased without increasing blurring, thus allowing for better hold down force. Moreover, the flowing of air around the printheads may have other beneficial effects, such as removing dust and otherwise adjusting the environment around the printheads.

Figure 2:
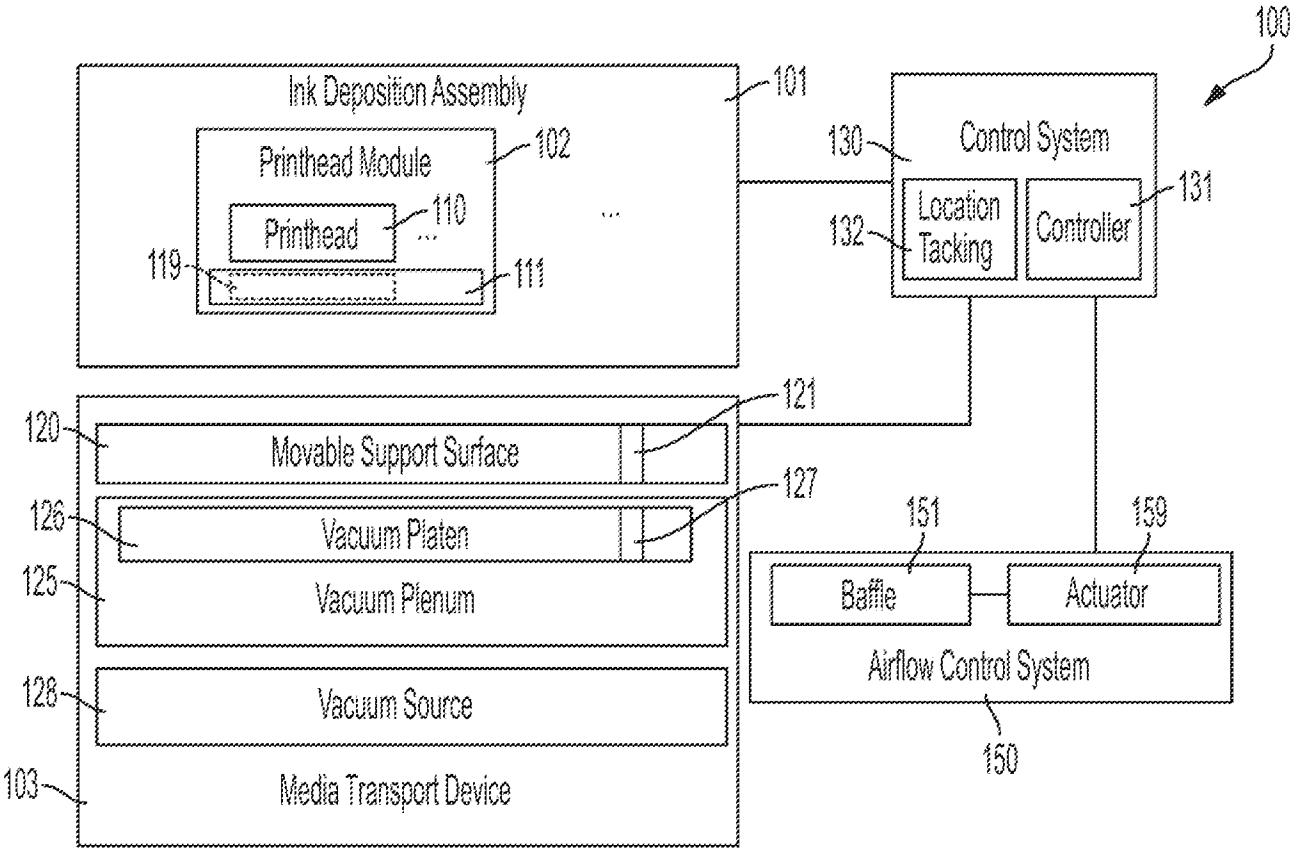
FIG. 2 comprises is a block diagram illustrating components of an embodiment of an inkjet printing system including an air flow control system.

FIG. 2 is a block diagram schematically illustrates a printing system 100 utilizing the above-described airflow control system. The printing system 100 comprises an ink deposition assembly 101, a media transport device 103, an airflow control system 150, and a control system 130. These components of the printing system 100 are described in greater detail in turn below.

The ink deposition assembly 101 comprises one or more printhead modules 102. One printhead module 102 is illustrated in FIG. 2 for simplicity, but any number of printhead modules 102 may be included in the ink deposition assembly 101. In some embodiments, each printhead module 102 may correspond to a specific ink color, such as cyan, magenta, yellow, and black. Each printhead module 102 comprises one or more printheads 110 configured to eject print fluid, such as ink, onto the print media to form an image. In FIG. 2, one printhead 110 is illustrated in the printhead module 102 for simplicity, but any number of printheads 110 may be included per printhead module 102. The printhead modules 102 may comprise one or more walls, including a bottom wall which may be referred to herein as a carrier plate 111. The carrier plate 111 comprises printhead openings 119, and the printheads 110 are arranged to eject their ink through the printhead openings 119. In some embodiments, the carrier plate 111 supports the printheads 110. In other embodiments, the printheads 110 are supported by other structures. The printhead modules 102 may also include additional structures and devices to support and facilitate operation of the printheads 110, such as, ink supply lines, ink reservoirs, electrical connections, and so on, as known in the art.

As shown in FIG. 2, the media transport device 103 comprises a movable support surface 120, a vacuum plenum 125, and a vacuum source 128. The movable support surface 120 transports the print media through a deposition region of the ink deposition assembly 101. The vacuum plenum 125 supplies vacuum suction to one side of the movable support surface 120 (e.g., a bottom side), and print media is supported on an opposite side of the movable support surface 120 (e.g., a top side). Holes 121 through the movable support surface 120 communicate the vacuum suction through the surface 120, such that the vacuum suction holds down the print media against the surface 120. The movable support surface 120 is movable relative to the ink deposition assembly 101, and thus the print media held against the movable support surface 120 is transported relative to the ink deposition assembly 101 as the movable support surface 120 moves. Specifically, the movable support surface 120 transports the print media through a deposition region of the ink deposition assembly 101, the deposition region being a region in which print fluid (e.g., ink) is ejected onto the print media, such as a region under the printhead(s) 110. The movable support surface 120 can comprise any structure capable of being driven to move relative to the ink deposition assembly 101 and which has holes 121 to allow the vacuum suction to hold down the print media, such as a belt, a drum, etc. The vacuum plenum 125 comprises baffles, walls, or any other structures arranged to enclose or define an environment in which a vacuum state (e.g., low pressure state) is maintained by the vacuum source 128, with the plenum 125 fluidically coupling the vacuum source 128 to the movable support surface 120 such that the movable support surface 120 is exposed to the vacuum state within the vacuum plenum 125. In some embodiments, the movable support surface 120 is supported by a vacuum platen 126, which may be a top wall of the vacuum plenum 125. In such an embodiment, the movable support surface 120 is fluidically coupled to the vacuum in the plenum 125 via holes 127 through the vacuum platen 126. In some embodiments, the movable support surface 120 is itself one of the walls of the vacuum plenum 125 and thus is exposed directly to the vacuum in the plenum 125. The vacuum source 128 may be any device configured to remove air from the plenum 125 to create the low-pressure state in the plenum 125, such as a fan, a pump, etc.

The control system 130 comprises processing circuitry to control operations of the printing system 100. The processing circuitry may include one or more electronic circuits configured with logic for performing the various operations described herein. The electronic circuits may be configured with logic to perform the operations by virtue of including dedicated hardware configured to perform various operations, by virtue of including software instructions executable by the circuitry to perform various operations, or any combination thereof. In examples in which the logic comprises software instructions, the electronic circuits of the processing circuitry include a memory device that stores the software and a processor comprising one or more processing devices capable of executing the instructions, such as, for example, a processor, a processor core, a central processing unit (CPU), a controller, a microcontroller, a system-on-chip (SoC), a digital signal processor (DSP), a graphics processing unit (GPU), etc. In examples in which the logic of the processing circuitry comprises dedicated hardware, in addition to or in lieu of the processor, the dedicated hardware may include any electronic device that is configured to perform specific operations, such as an Application Specific Integrated Circuit (ASIC), a Field Programmable Gate Array (FPGA), a Complex Programmable Logic Device (CPLD), discrete logic circuits, a hardware accelerator, a hardware encoder, etc. The processing circuitry may also include any combination of dedicated hardware and general-purpose processor with software. The control system 130 may include a location tracking system 131 and a controller 131, which are described in greater detail below.

The airflow control system 150 comprises one or more baffles 151 and corresponding actuators 159. Each baffle 151 is associated with one or more printhead openings 119 in a carrier plate 111 of a printhead module 102, and the baffle(s) 151 are arranged around the associated printhead opening(s) 119. For example, the baffles 151 may be disposed above and/or below the carrier plate 111 around the associated printhead openings 119. In some embodiments, a given baffle 151 may be associated with multiple printhead openings 119. For example, in one embodiment a single baffle 151 is associated with all of the printhead openings 119 in an individual printhead module 102. In some embodiments, a given baffle 151 may be associated with a single printhead opening 119, and thus multiple baffles 151 may be respectively associated with each of multiple printhead openings. In some embodiments, different baffles 151 are associated with different numbers of printhead openings 119.

Each baffle 151 is independently movable between the upstream-blocking configuration and the downstream-blocking configuration, as described above. Each baffle 151 comprises one upstream-blocking portion for each of its associated printhead openings 119, with the upstream-blocking portion blocking airflow through an upstream side of the respective printhead opening 119 when the baffle 151 is in the upstream-blocking configuration and not blocking airflow when the baffle 151 is in the downstream-blocking configuration. Similarly, each baffle 151 also comprises one downstream-blocking portion for each of its associated printhead openings 119, with the downstream-blocking portion blocking airflow through a downstream side of the respective printhead opening 119 when the baffle 151 is in the downstream-blocking configuration and not blocking airflow when the baffle 151 is in the upstream-blocking configuration. The upstream-blocking portion and the downstream-blocking portion are coupled together such that moving one of the portions to a blocking position results in the other portion moving to a non-blocking position, and vice-versa. In some embodiments, the baffle 151 is moved between the upstream-blocking and downstream-blocking configurations by translating the baffle 151 relative to the carrier plate (e.g., along the process direction), such as in the embodiments of FIGS. 4-7F. In other embodiments, the baffle 151 is moved between the upstream-blocking and downstream-blocking configurations by rotating the baffle 151 relative to the carrier plate 111 (e.g., about an axis extending in the cross-process direction), such as in the embodiments of FIGS. 8-9.

The actuator 159 is a device configured to drive movement of the baffle 151 between the upstream-blocking and downstream-blocking configurations. The actuator 159 can be of a variety of types, including but not limited to, for example, a hydraulic or pneumatic piston, a solenoid, a linear actuator, a hydraulic or pneumatic rotary actuator, an electric motor, a rotary actuator, etc. The actuator 159 may utilize electrical motive power, hydraulic motive power, pneumatic motive power, or any other desired motive power. The actuator 159 may also comprise various motion/force conversion mechanisms or linkages, such as linear-to-rotary conversion mechanisms, rotary-to-linear conversion mechanisms, or any other linkages to transfer and/or convert motion of the actuator 159 into the desired motion of the baffle 151.

As noted above, the airflow control system 150 is configured to selectively move the baffles 151 based on the location of the inter-media zone 122. Because the lead edge LE and the trail edge TE of the print media 105 define the boundaries of the inter-media zone 122, referring to a location of the inter-media zone 122 is equivalent to referring to corresponding locations of the lead edge LE and trail edge TE of the print media 105. Thus, reference herein to the airflow control system 150 moving the baffles 151 based on the location of the inter-media zone 122 is equivalent to the airflow control system 150 moving the baffles 151 based on the locations of the lead edge LE and trail edges TE of the print media 105. "Selectively" in this context refers to the capability of the airflow control system 150 to independently move the baffles 151, during printing operations of the printing system 100, between the upstream-blocking and downstream-blocking configurations. Moreover, selectively moving the baffles based on the location of the inter-media zone can occur by the airflow control system 150 independently moving the baffles 151 at timings that correspond to positions (which may be predetermined or determined dynamically) of the inter-media zone 122—e.g., positions of the inter-media zone 122 are used as triggers for changing the baffles 151 between upstream-blocking and downstream-blocking configurations. The positions may be defined relative to a reference location or object, such as a printhead opening (or part thereof), a printhead 110 (or part thereof), a baffle 151 (or part thereof), etc. As will be explained further below, a determination of where an inter-media zone 122 is located may be made based on detecting positions of the print media 105.

In some embodiments, each baffle 151 is controlled such that it is in the downstream-blocking configuration at least while the trail edge TE of a print medium 105 (i.e., the downstream edge of the inter-media zone 122) is located under any of the printheads associated with the baffle 151. Conversely, each baffle 151 is controlled such that it is in the upstream-blocking configuration at least while the lead edge LE of a print medium 105 (i.e., the upstream edge of the inter-media zone 122) is under the any of the printheads 110 associated with the baffle 151. The precise timings at which the baffle 151 is switched between these configurations may depend on factors such as: the speed of actuation of the actuator 159, the width of the inter-media zone 122 in the process direction (i.e., the gap distance between adjacent print media 105), the sensitivity of baffle 151 movement to actuation by the actuator 159, the speed of the movable support surface 120, and other similar factors.

In particular, in some embodiments the baffle 151 is moved into the downstream-blocking configuration at or before the timing when the downstream edge of the inter-media zone 122 (which corresponds to the trail edge TE of a print medium 105) is at an upstream position associated with the baffle 151. Conversely, each baffle 151 may be moved to the upstream-blocking configuration when the downstream edge of the inter-media zone 122 reaches a downstream position associated with the baffle 151 and/or when the upstream edge of the inter-media zone 122 (which corresponds to the lead edge LE of a print medium 105) reaches the upstream position associated with the baffle 151. In some embodiments, the upstream position associated with a given baffle 151 is one of: an upstream edge of a carrier plate associated with the baffle 151, an upstream edge of a printhead opening associated with the baffle 151, an upstream edge of a printhead associated with the baffle 151, an upstream edge of the baffle 151, an upstream edge of an ink deposition region of a printhead associated with the baffle, or any desired location upstream of the ink deposition region. In some embodiments, the downstream position associated with the baffle 151 is one of: a downstream edge of a carrier plate associated with the baffle 151, a downstream edge of a printhead opening associated with the baffle 151, a downstream edge of a printhead associated with the baffle 151, a downstream edge of the baffle 151, a downstream edge of an ink deposition region of a printhead associated with the baffle, or any desired location downstream of the ink deposition region. In some embodiments, the upstream position associated with a given baffle 151 is any predetermined position on an upstream side of the baffle 151, while the downstream position associated with the given baffle 151 is any predetermined position on a downstream side of the baffle 151, with such positions being chosen based on a variety of factors as noted above and would be understood by those having ordinary skill in the art in view of the principles of operation of various embodiments as disclosed herein.

Thus, in some embodiments, a given baffle 151 is in the downstream-blocking configuration whenever the downstream edge of the inter-media zone 122 (i.e., trail edge TE of print medium 105) is located under the ink deposition region of any printheads 110 associated with the given baffle 151 and the given baffle 151 is in the upstream-blocking configuration whenever the upstream edge of the inter-media zone 122 (i.e., lead edge LE of print medium 105) is located under the ink deposition region of any printheads 110 associated with the given baffle 151. Positioning and actuation of the baffles in accordance with embodiments are discussed in greater detail below in relation to FIGS. 4-9.

A controller 131, which may be part of the control system 130, is configured to determine when to move the baffles 151 between upstream-blocking and downstream-blocking configurations. The controller 131 also generates signals to control the actuators 159 to cause the actuators 159 to move the baffles 151 at the determined timings. The controller 131 comprises one or more electronic circuits configured with logic to perform the options described herein. In some embodiments, the electronic circuits of the controller 131 are part of the processing circuitry of the control system 130 described above. Although illustrated as part of the control system 130, because the controller 131 controls operations of the airflow control system 150, the controller 131 may also be considered as part of the airflow control system 150. Thus, certain operations described herein as being performed by the airflow control system 150 may be performed by the controller 131. The physical location of the hardware forming the controller 131 is not limited.

A location tracking system 131 may be used to track the locations of the inter-media zones 122 and/or print media 105 as the print media 105 are transported through the ink deposition assembly. As used herein, tracking the location of the inter-media zones 122 or the print media 105 refers to the system having knowledge, whether direct or inferred, of where the print media 105 are located at various points as they are transported through the ink deposition assembly 101. Direct knowledge of the locations of the inter-media zones 122 or print media 105 may comprise information obtained by directly observing the print media 105, for example via one or more sensors (e.g., an edge detection sensor). Inferred knowledge of the locations of the inter-media zones 122 or print media 105 may be obtained by inference from other known information, for example by calculating how far a print medium 105 would have moved from a previously known location based on a known speed of the movable support surface 120. In some embodiments, the location tracking system 131 may explicitly track locations of the inter-media zones 122, the lead edges LE of print media 105, and/or the trail edges TE of print media 105. In other embodiments, the location tracking system may explicitly track the locations of some other parts of the print medium 105. Because the locations of the inter-media zones 122 depend deterministically on the locations of the print media 105 and on the dimensions of the print media 105 (which are known to the controller), tracking the locations of some arbitrary part of the print media 105 is functionally equivalent to tracking the locations of the inter-media zones 122. In some embodiments, the location tracking system 131 may be part of the control system 130.

Most existing printing systems are already configured to track the locations of the print media 105 as they are transported through the ink deposition assembly, as knowledge of the locations of the print media may be helpful to ensure accurate image formation on the print media. Thus, various systems for tracking the locations of print media are well known in the art. Because such location tracking systems are well known, they will not be described in detail herein. Any known location tracking system (or any new location tracking system) may be used in the embodiments disclosed herein to track the location of print media, and a controller may use this information to determine the locations of the lead edge LE and/or the trail edge TE (if not already known).

Turning now to FIGS. 3-9, various embodiments of printing systems will be described, which can be used as the printing system 100. In the Figures and the description below, indexes such as "_1", "_2", etc. are appended to the end of the reference numbers of some components. These indexes are used when a plurality of similar components are present and it is desired to refer to a specific one of those components. However, when the components are being referred to generally or collectively without a need to distinguish between specific ones, the index may be omitted. Thus, as one example, a baffle 351 may be labeled and referred to as a first baffle 351_1 when it is desired to identify a specific one of the baffles 351, as in FIG. 4 but it may also be labeled and referred to as simply a baffle 351 in other cases in which it is not desired to distinguish between multiple baffles 351, as in FIGS. 5A-5E.

Figure 3:
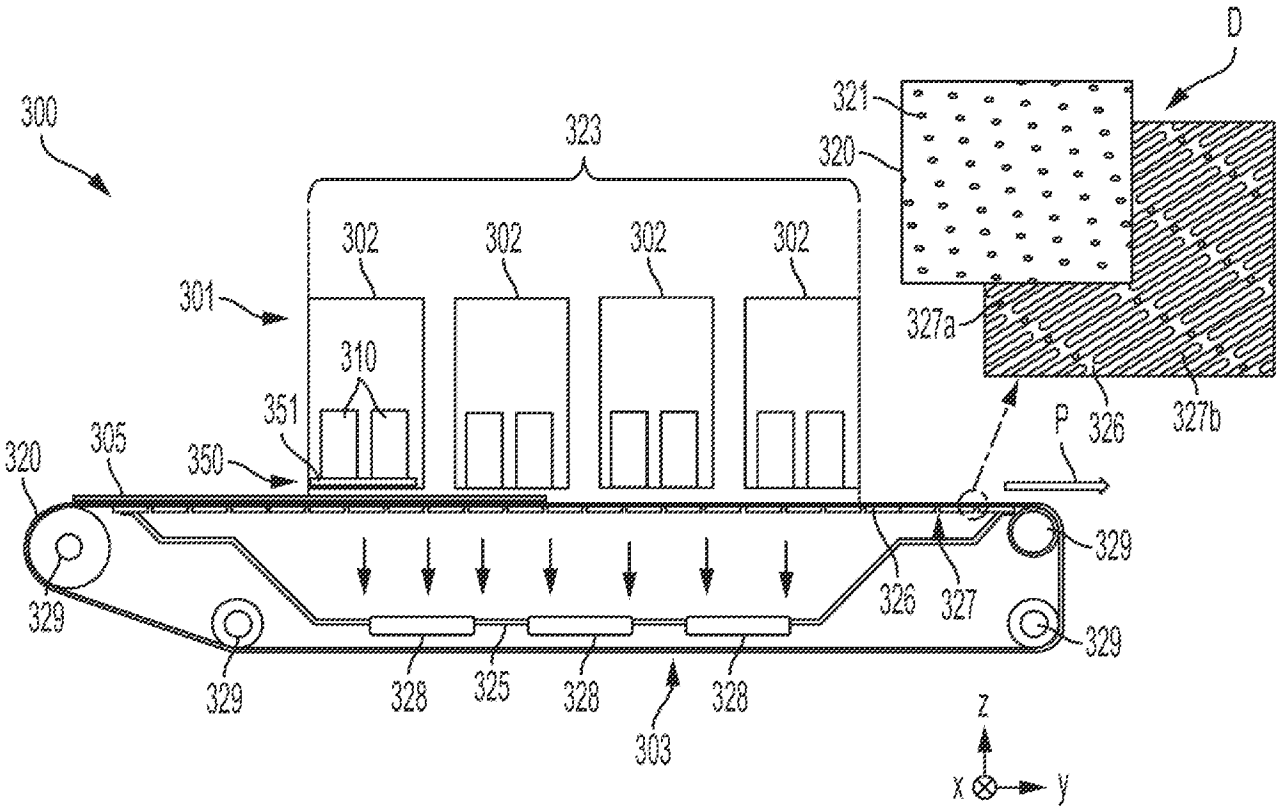
FIG. 3 is a schematic illustration of an ink deposition assembly, media transport device, and air flow control air flow control system of one embodiment of an inkjet printing system.
Figure 4:
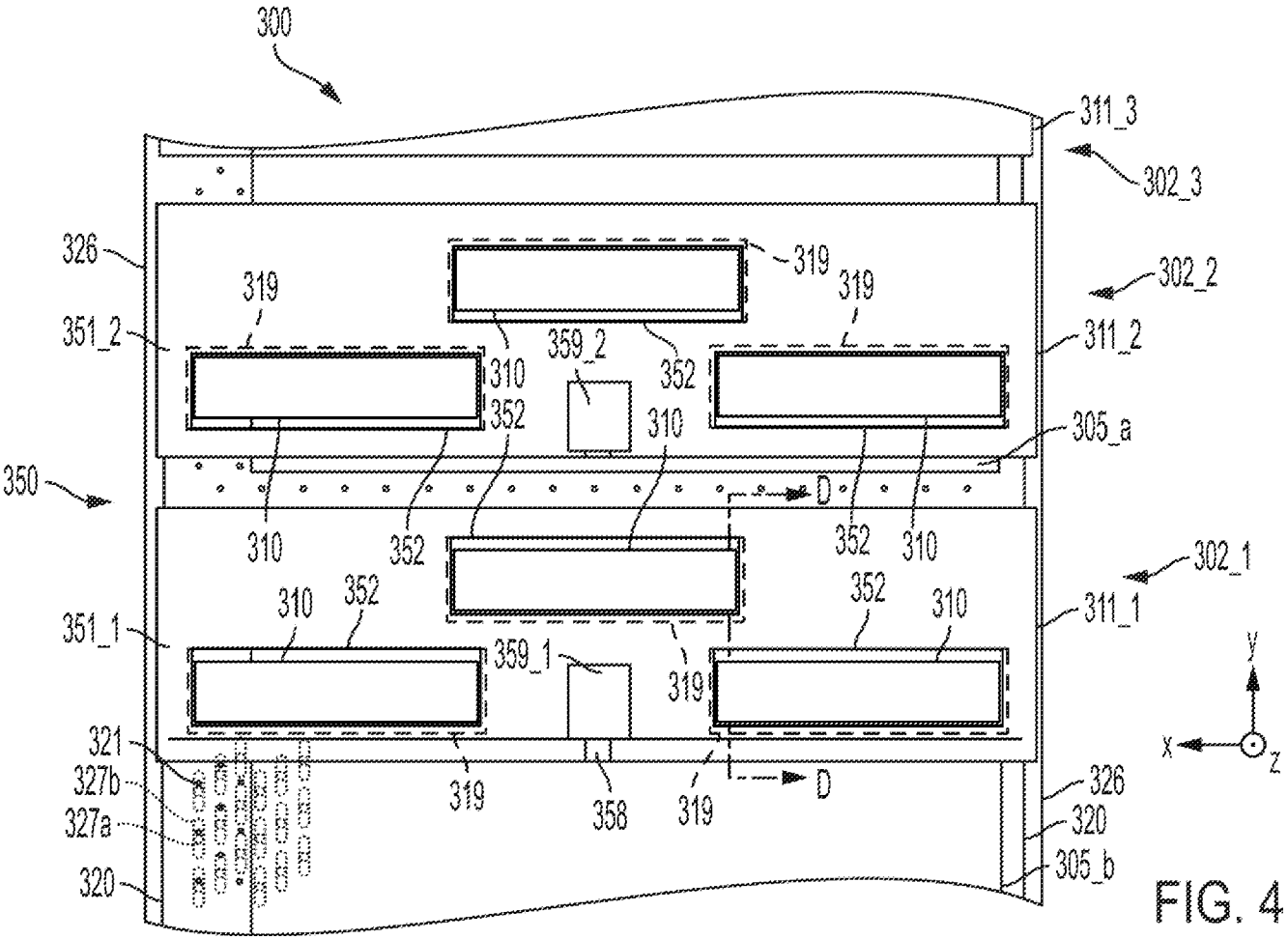
FIG. 4 is a plan view from above the printhead assembly of the inkjet printing system of FIG. 3.

FIGS. 3-5E illustrate a printing system 300, which may be used as the printing system 100 described above with reference to FIG. 2. FIG. 3 comprises a schematic illustrating a portion of the printing system 300 from a side view. FIG. 4 comprises a plan view from above a portion of the printing system 300. In FIG. 4, some components that would not otherwise be visible in the view because they are positioned below other components are illustrated with dashed or dotted lines. FIGS. 5A-5E comprise cross-sections of the printing system 300 with the section taken along line D-D in FIG. 4, with each of FIGS. 5A-5E showing a sequence of states as the print media 305*a* and 305*b* are transported past one of the printhead modules 302.

As illustrated in FIG. 3, the printing system 300 comprises an ink deposition assembly 301, a media transport device 303, and an airflow control system 350, which can be used as the ink deposition assembly 101, media transport device 103, and airflow control system 150, respectively. The printing system 300 may also comprise additional components not illustrated in FIGS. 3-5E, such as a control system (e.g., the control system 130).

In the printing system 300, the ink deposition assembly 301 comprises four printhead modules 302 as shown in FIG. 3, with each module 302 having three printheads 310 as shown in FIG. 4. As shown in FIGS. 3 and 4, the printhead models 302 are arranged in series along a process direction P above the media transport device 303, such that the print media 305 is transported sequentially beneath each of the printhead modules 302. The printheads 310 are arranged to eject print fluid (e.g., ink) through respectively corresponding printhead openings 319 in a corresponding carrier plate 311, with a bottom end of the printhead 310 extending down partway into the printhead openings 319. In this embodiment, the printheads 310 are arranged in an offset pattern with one of the printheads 310 being further upstream or downstream than the other two printheads 310 of the same printhead module 302. In other embodiments, different numbers and/or arrangements of printheads 310 and/or printhead modules 302 are used.

In the printing system 300, media transport device 303 comprises a flexible belt providing the movable support surface 320. As shown in FIG. 3, the movable support surface 320 is driven by rollers 329 to move along a looped path, with a portion of the path passing through the ink deposition region 323 of the ink deposition assembly 301. Furthermore, in this embodiment, the vacuum plenum 325 comprises a vacuum platen 326, which forms a top wall of the plenum 325 and supports the movable support surface 320. The platen 326 comprises platen holes 327, which allow fluidic communication between the interior of the plenum 325 and the underside of the movable support surface 320.

In some embodiments, the platen holes 327 may include channels on a top side thereof, as seen in the expanded cutaway of FIG. 3, which may increase an area of the opening of the holes 327 on the top side thereof. Specifically, the platen holes 327 may include a bottom portion 327*a* which opens to a bottom side of the platen 326 and a top portion 327*b* which opens to a top side of the platen 326, with the top portion 327*b* being differently sized and/or shaped than the bottom portion 327*a*. For example, FIGS. 3-5E illustrate an embodiment of the platen holes 327 in which the top portion 327*b* is a channel elongated in the process direction while the bottom portion 327*an* is a through-hole that is less-elongated and has a smaller sectional area (see the enlargement D in FIG. 3 and the dashed-lines in FIG. 4). In some embodiments, multiple holes 327 may share the same top portion 327*b*, or in other words multiple bottom portions 327*a* may be coupled to the same top portion 327*b*.

The holes 321 of the movable support surface 320 are disposed such that each hole 321 is aligned in the process direction (y-axis) with a collection of corresponding platen holes 327. Thus, as the movable support surface 320 moves across the platen 326, each hole 321 will periodically move over a corresponding platen hole 327, resulting in the hole 321 and the platen hole 327 being temporarily vertically aligned (i.e., aligned in a z-axis direction). When a hole 321 moves over a corresponding platen hole 327, the holes 321 and 327 define an opening that fluidically couples the environment above the movable support surface 320 to the low-pressure state in the vacuum plenum 325, thus generating vacuum suction through the holes 321 and 327. This suction generates a vacuum hold down force on a print medium 305 if the print medium 305 is disposed above the holes 321.

As shown in FIGS. 3-5E, the airflow control system 350 comprises baffles 351 and corresponding actuators 359 to move the baffles 351. The baffles 351 and actuators 359 may be used as the baffles 151 and actuators 159 described above in relation to FIG. 2. In the printing system 300, there is one baffle 351 and one actuator 359 per printhead module 302, with each baffle 351 being associated with all of the printheads 310 of the printhead module 302. Thus, in FIG. 4, a first baffle 351_1 is associated with a first printhead module 302_1 and blocks each of the printhead openings 319 in the carrier plate 311_1, a second baffle 351_2 is associated with a second printhead module 302_2 and the carrier plate 311_2, and so on. In other embodiments other numbers of baffles 351 and actuators 359 may be provided per printhead module 302, and fewer or more printheads 310 may be associated with each baffle 351.

In the printing system 300, the baffles 351 are disposed above the carrier plate 311 as shown in FIGS. 3-5E. The baffles 351 may rest on the carrier plate itself, or on some other support structure such as guide rails. The baffles 351 comprise, for example, plates of solid material and may be made of any suitable material that is stiff enough to not buckle or bind while being actuated, such as various metals (e.g., stainless steel, plated steel, aluminum, brass), various plastics/polymers (e.g., polyethylene, polycarbonate, Nylon), carbon fiber, fiberglass, etc. As shown in FIGS. 4 and 5A, each baffle 351 comprises baffle openings 352 which surround corresponding printheads 310. In FIG. 4, the baffle 351 is generally rectangular in profile, but the shape of the baffle 351 is not limited to this. The baffle 351 may have any desired shape as long as the baffle 351 can fit within the printhead module 302, can be moved as described herein, and has baffle openings 352 arranged such that the baffle 351 can block the upstream and downstream sides of the printhead opening 319 in the printhead module 302, as described in further detail below.

Figure 5A:
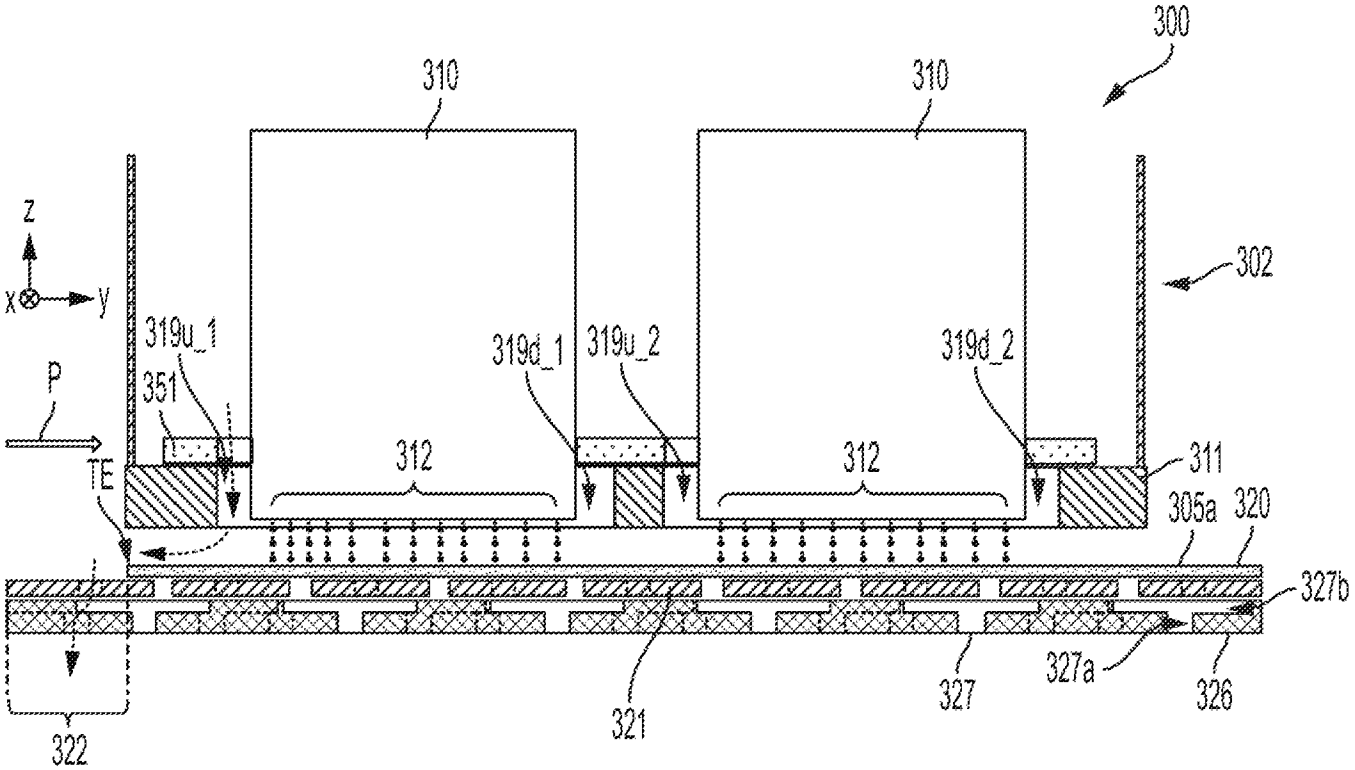
FIGS. 5A-5E are cross-sectional views of the inkjet printing system of FIG. 4, with the cross-section taken along D in FIG. 4.

The baffle 351 is movable in translation along the process direction between the upstream-blocking and downstream-blocking configurations. In the upstream-blocking configuration, the upstream rim of each baffle opening 352 is against (or sufficiently close to) the corresponding printhead 310 such that a portion of the baffle 351 extends across and substantially covers the portion of the opening 319 on an upstream side of the printhead 310 (hereinafter "upstream gap 319*u*"), thereby blocking airflow through the upstream gap 319*u*. In FIG. 4 the baffle 351_1 is shown in the upstream-blocking configuration. FIG. 5A also illustrates the baffle 351 in the upstream-blocking configuration. In the downstream-blocking configuration, the downstream rim of each baffle opening 352 is against (or sufficiently close to) the corresponding printhead 310 such that a portion of the baffle 351 extends across and substantially covers the portion of the printhead opening 319 on a downstream side of the printhead 310 (hereinafter "downstream gap 319*d*"), thereby blocking airflow through the downstream gap 319*d*. In FIG. 4 the baffle 351_2 is shown in the downstream-blocking configuration. FIG. 5C also illustrates the baffle 351 in the downstream-blocking configuration.

Each baffle 351 may have a corresponding actuator 359 to drive the movement of the baffle 351. Thus, in FIG. 4 the baffle 351_1 has an actuator 359_1 and the baffle 351_2 has an actuator 359_2. The actuator 359 imparts translational motion in the process direction to a corresponding baffle 351, thereby causing the baffle 351 to move between the upstream-blocking and downstream-blocking configurations. In FIG. 4, the actuator 359 is a linear actuator that drives an output 358, such as a piston, to move linearly. In other embodiments, the actuator 359 may be a rotary actuator that drives an output to rotate, and the rotation of the output may be converted into translation of the baffle 351 via a rotary-to-linear conversion mechanism such as a rack-and-pinion, capstan, screw drive, chain drive, etc. In FIG. 4, the actuator 359 fixed relative to the baffle 351 while the motion output 358 is fixed relative to the printhead module 302 (e.g., attached to a side wall of a chassis of the printhead module 302). In other embodiments, the actuator 359 could be fixed relative to the printhead module 302 and the motion output 358 could be fixed relative to the baffle 351. Any device capable of generating translation of the baffle 351 may be used as the actuator 359, such as a solenoid, a hydraulic actuator, a pneumatic actuator, an electrical motor etc.

As described above, the airflow control system 350 is configured to move the baffles 351 at timings based on the position of the inter-media zone 322. Each baffle 351 has an upstream trigger location and a downstream location associated with it, and the baffle 351 is moved based on the location of the inter-media zone relative to these trigger locations. Specifically, in the printing system 300, a given baffle 351 is placed in the downstream-blocking configuration at of before the timing when the downstream edge of the inter-media zone 322 (the trail edge TE of a print medium 305) arrives at the upstream trigger location. This timing corresponds generally to the timing of the inter-media zone 322 arriving at and starting to travel under the printheads 310 associated with the baffle 351. The baffle 351 is moved to the upstream-blocking configuration when the downstream edge of the inter-media zone 322 (trail edge TE of a print medium 305) arrives at the downstream trigger location. This timing corresponds generally to a timing of the inter-media zone 322 beginning to emerge from under the printheads 310 on a downstream side thereof.

In some embodiments, the upstream trigger location associated with a given baffle 351 may be any of: an upstream edge of a carrier plate associated with the baffle 351, an upstream edge of a printhead opening associated with the baffle 351, an upstream edge of a printhead associated with the baffle 351, an upstream edge of the baffle 351, an upstream edge of an ink deposition region of a printhead associated with the baffle, or any predetermined location upstream of the ink deposition region. In some embodiments, the downstream trigger location associated with the baffle 351 is one of: a downstream edge of a carrier plate associated with the baffle 351, a downstream edge of a printhead opening associated with the baffle 351, a downstream edge of a printhead associated with the baffle 351, a downstream edge of the baffle 351, a downstream edge of an ink deposition region of a printhead associated with the baffle, or any predetermined location downstream of the ink deposition region.

In practice, it takes a finite amount of time for the baffle 351 to move between configurations, and during this time while the baffle 351 is moving the inter-media zone 322 continues to move. Thus, in some embodiments, to ensure that the baffle 351 is in the intended configuration when the inter-media zone 322 reaches a desired trigger location ("nominal trigger location"), the actuator 359 may be controlled to start moving the baffle 351 at a time just before the inter-media zone 322 actually reaches the nominal trigger location. In other words, an actual trigger location that is used to trigger the extending or retracting may be offset from the nominal trigger location by some fixed amount to account for the finite amount of time it takes the baffle 351 to extend or retract. The known speed of the movable support surface 320 and a known deployment time for the baffle 351 may be used to determine the offset.

The operations of the baffles 351 and how they reduce crossflows are explained in greater detail below with reference to FIGS. 5A-5E. FIGS. 5A-5E comprise cross sections taken along D in FIG. 4 and illustrate various positions of the inter-media zone 322 and corresponding configurations of the baffles 351. In FIGS. 5A-5E, it is assumed that the upstream trigger location corresponds to an upstream edge of the carrier plate 311 and the downstream trigger location corresponds to a downstream edge of the last (most downstream) printhead 310 associated with the baffle 351.

FIG. 5A illustrates the inter-media zone 322 in a first position. The first position corresponds to the downstream edge of the inter-media zone 322 (i.e., the trail edge TE of the print medium 305*a*) reaching an upstream trigger location associated with the baffle 351. Specifically, the inter-media zone 322 reaches the first trigger location when the trail edge TE of the print medium 305*a* is at (i.e., vertically aligned with) the upstream edge of the carrier plate 311. Thus, at or before the timing when the inter-media zone 322 reaches the first position, the controller causes the corresponding actuator (not shown) to move the baffle 351 to the downstream-blocking configuration. In this configuration, the baffle 351 blocks airflow through the downstream gaps 319*d* while allowing airflow through the upstream gaps 319*u*. As the print media 305*a* continues to move downstream, the baffle 351 remains in the downstream-blocking configuration, as shown in FIG. 5B.

Figure 5B:
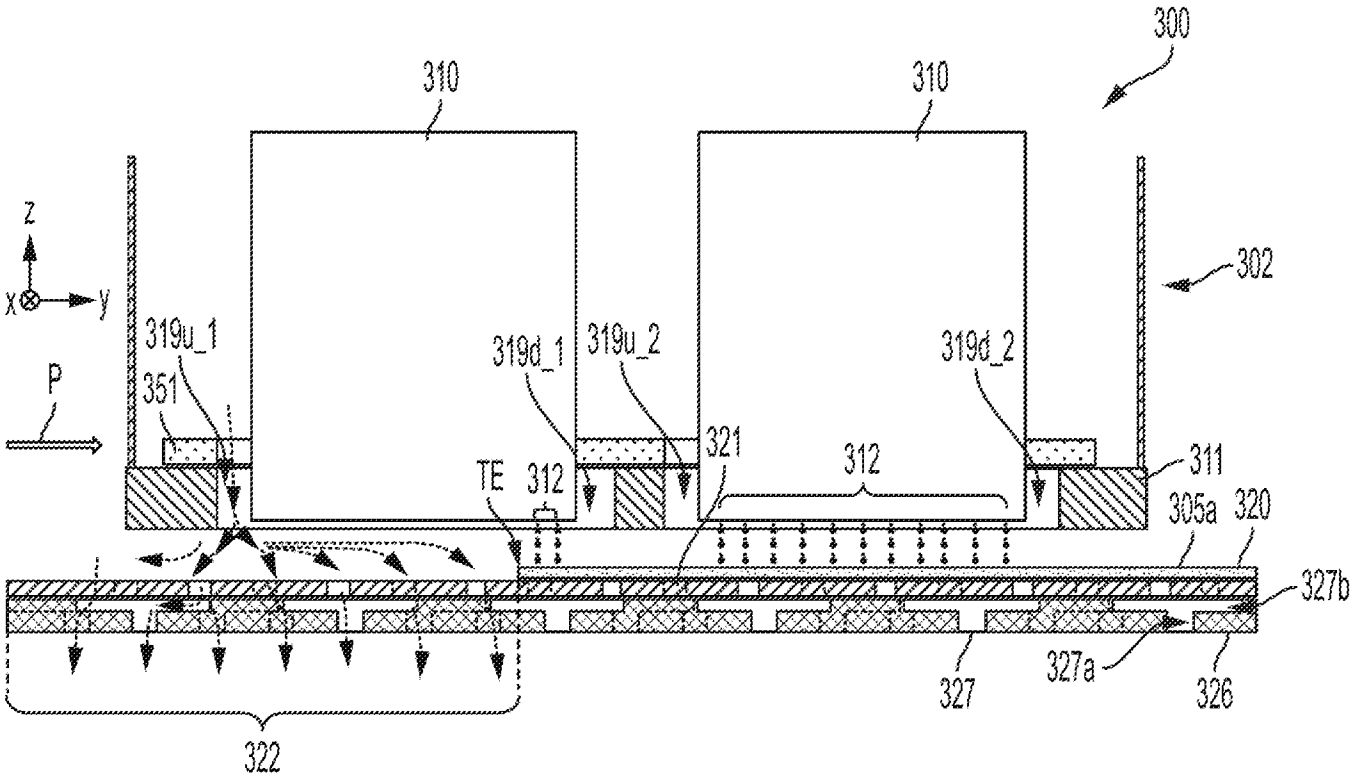
Figure 5C:
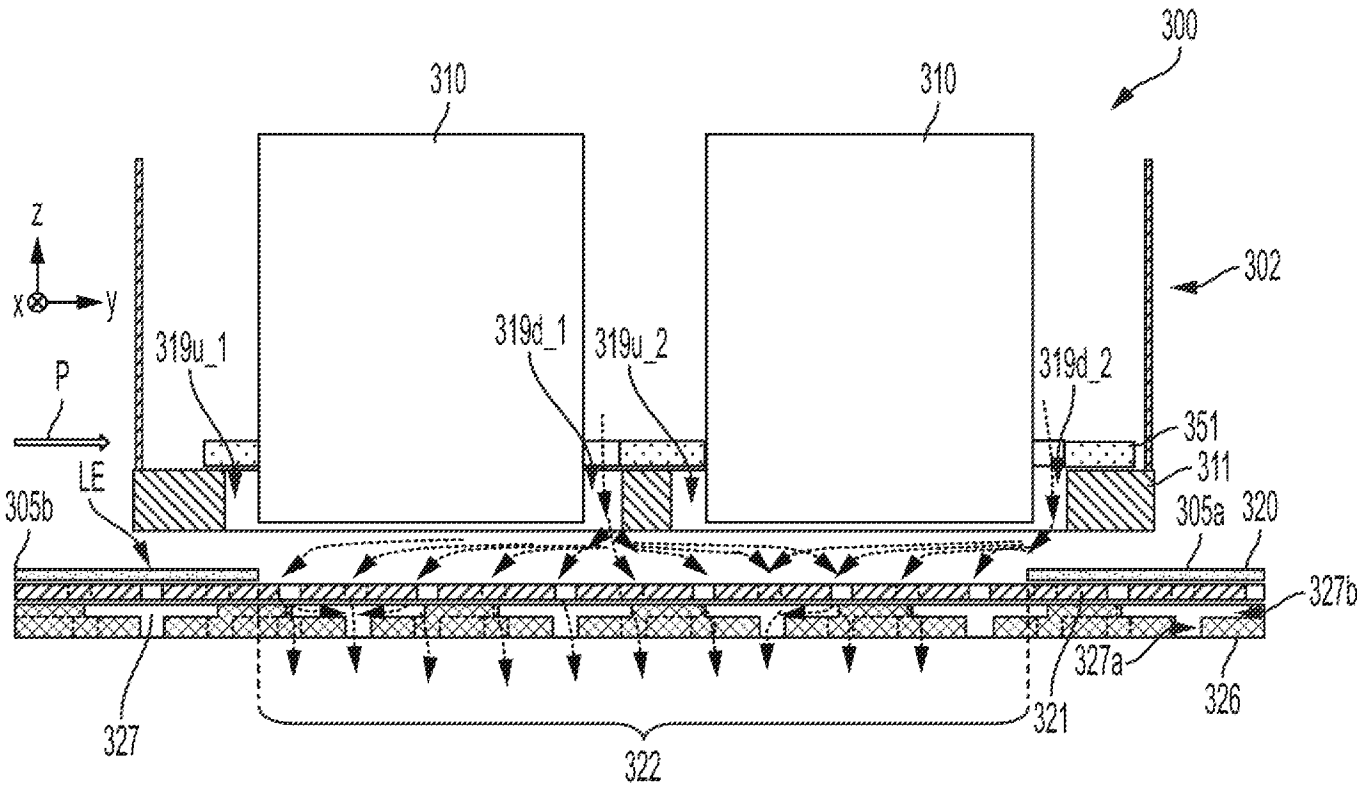

Because the baffle 351 blocks airflow through the downstream gaps 319*d* when printing is occurring near the trail edge TE of a print medium, as in FIGS. 5A and 5B, crossflows that might otherwise flow through these gaps may be eliminated. For example, in the state shown in FIG. 5A, if the baffle 351 were not present, the inter-media zone 322 might pull some air from the first downstream gap 319*d*_1 and this air would cross through the ink deposition region 312 and might cause image blur. But because the baffle 351 blocks the downstream gaps 319*d*, this crossflow is prevented. Similarly, in the state shown in FIG. 5B, if the baffle 351 were not present, the inter-media zone 322 might pull some air from the second downstream gap 319*d*_2 and this air would cross through the ink deposition region 312 and might cause image blur. But because the baffle 351 blocks the downstream gaps 319*d*, this crossflow is prevented.

Furthermore, because the baffle 351 leaves the upstream gaps 319*u* unblocked when printing is occurring near the trail edge TE of a print medium, as in FIGS. 5A and 5B, air can flow through the upstream gaps 319*u* towards the inter-media zone 322 to counteract some of the suction from the inter-media zone 322. This tends to reduce the strength with which air is pulled from other regions, thus reducing the occurrence and/or strength of crossflows. For example, in the state shown in FIG. 5A, the air flowing through the first upstream gap 319*u*_1 towards the inter-media zone 322 will tend to increase the pressure under the carrier plate 311 in that vicinity, which will relieve some of the pull experienced by air under the printhead 310. Thus, crossflows originating from under the printhead 310 are reduced in strength. Similarly, in the state shown in FIG. 5B, the air flowing through both the upstream gaps 319*u* meets the airflow needs of the inter-media zone 322, thus counteracting the lowered pressure and reducing the strength of suction from the downstream side of the printhead 310. Thus, crossflows originating from the downstream side of the printhead 310 are reduced in strength.

FIG. 5C illustrates the inter-media zone 322 at a position in which the downstream edge of the inter-media zone 322 (i.e., the trail edge TE of the print medium 305*a*) is at a downstream trigger location associated with the baffle 351. Specifically, in this example, the inter-media zone 322 reaches this trigger location when the trail edge TE of the print medium 305*a* is at the downstream edge of the furthest downstream printhead 310 associated with the baffle 351. Thus, at (or shortly before) the timing when the inter-media zone 322 reaches this position, the controller causes one of the actuators (not shown) to move the baffle 351 to the upstream-blocking configuration. In this configuration, the baffle 351 blocks airflow through the upstream gaps 319*u* while leaving the downstream gaps 319*d* are unblocked.

Figure 5D:
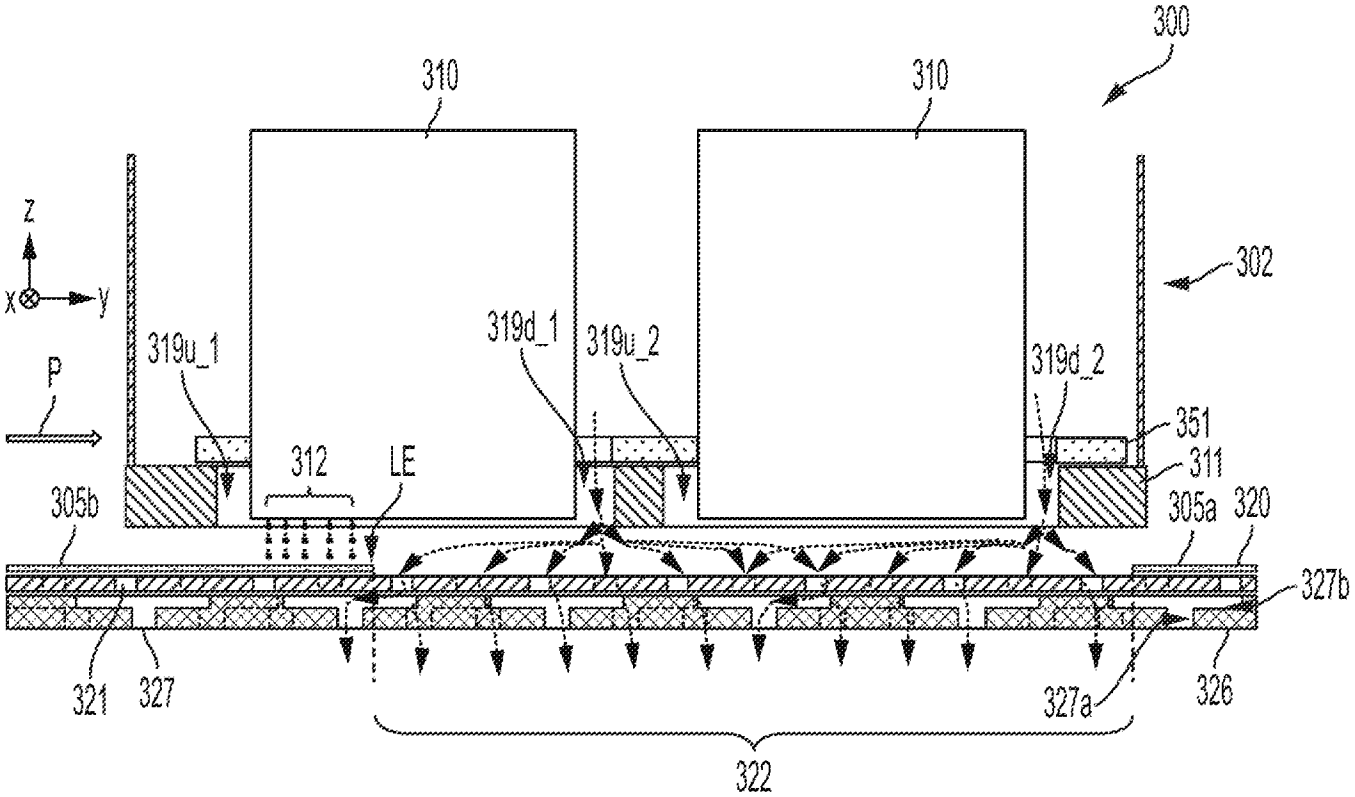

In the state illustrated in FIG. 5C, none of the print media 305 are being printed on, and thus crossflows are not a concern at that specific timing. However, after this point in time the print medium 305*b* will move into the deposition region 312 under the printhead 310 and start being printed on, as shown in FIG. 5D. Thus, the baffle 351 is moved into the upstream-blocking configuration at the timing illustrated in FIG. 5C to be ready to prevent crossflows once printing on the print medium 305*b* begins. The baffle 351 remains in the upstream-blocking configuration as the inter-media zone 322 continues to move downstream under the printheads 310, as illustrated in FIG. 5E.

Figure 5E:
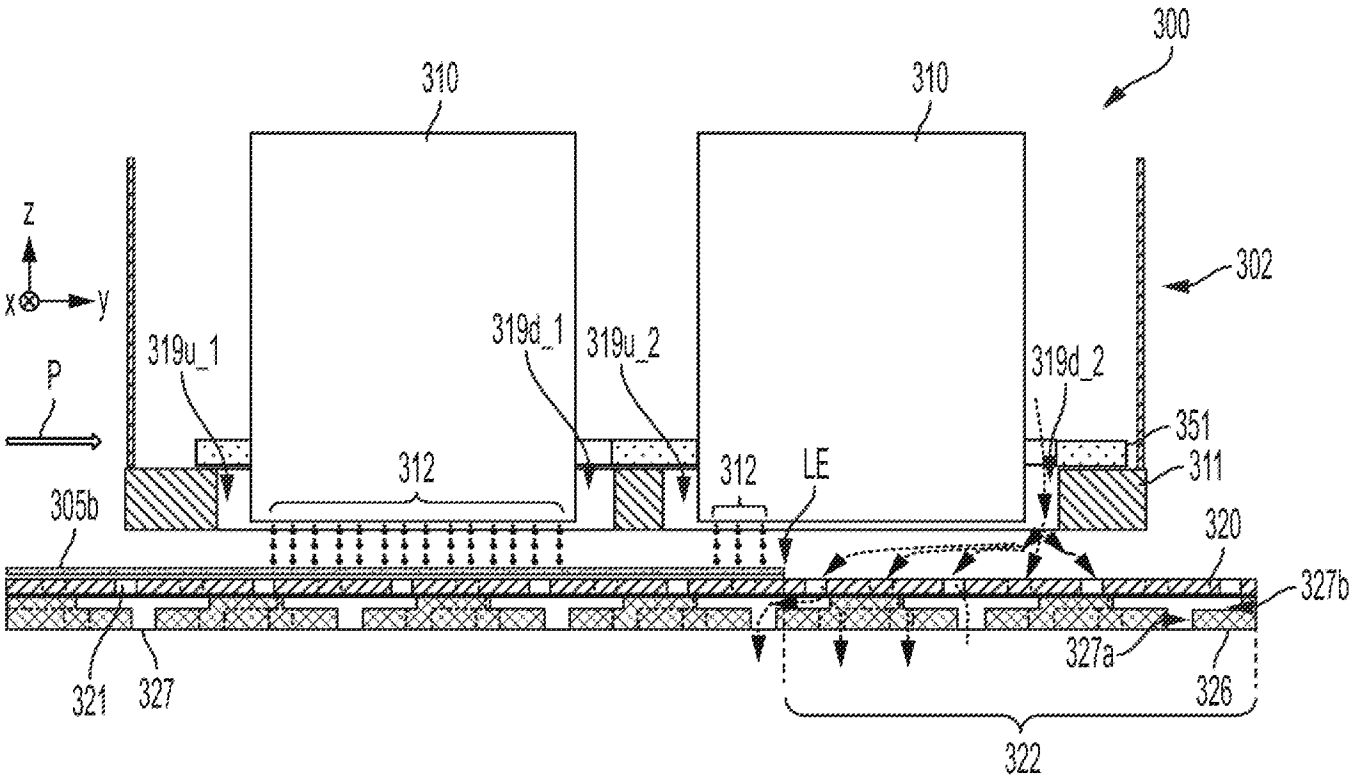

Because the baffle 351 blocks airflow through the upstream gaps 319*u* when printing is occurring near the lead edge LE of a print medium 305, as in FIGS. 5D and 5E, crossflows that might otherwise flow through these gaps may be eliminated. For example, in the state shown in FIG. 5D, if the baffle 351 were not present, the inter-media zone 322 might pull some air from the first upstream gap 319*u*_1 and this air would cross through the ink deposition region 312 and might cause image blur. But because the baffle 351 blocks the upstream gaps 319*u*, this crossflow is prevented. Similarly, in the state shown in FIG. 5E, if the baffle 351 were not present, the inter-media zone 322 might pull some air from the second upstream gap 319*u*_2 and this air would cross through the ink deposition region 312 and might cause image blur. But because the baffle 351 blocks the upstream gaps 319*u*, this crossflow is prevented.

Furthermore, because the baffle 351 leaves the downstream gaps 319*d* unblocked when printing is occurring near the lead edge LE of a print medium 305, as in FIGS. 5D and 5E, air can flow through the downstream gaps 319*d* towards the inter-media zone 322 to counteract some of the suction from the inter-media zone 322. This tends to reduce the strength with which air is pulled from other regions, thus reducing the occurrence and/or strength of crossflows. For example, in the state shown in FIG. 5D, the air flowing through both the downstream gaps 319*d* meets the airflow needs of the inter-media zone 322, thus counteracting the lowered pressure and reducing the strength of suction from the upstream side of the printhead 310. Thus, crossflows originating from the upstream side of the printhead 310 are reduced in strength. Similarly, in the state shown in FIG. 5E, the air flowing through the second downstream gap 319*d*_2 towards the inter-media zone 322 will tend to increase the pressure under the carrier plate 311 in that vicinity, which will relieve some of the pull experienced by air under the printhead 310. Thus, crossflows originating from under the printhead 310 are reduced in strength.

After the inter-media zone 322 has fully passed the printhead module 302 associated with the baffle 351, the position of the baffle 351 becomes less important from the perspective of reducing crossflows, as the inter-media zone 322 will likely be too distant to induce any significant crossflows. Thus, the baffle 351 may be placed in any desired position in this state. For example, the baffle 351 may be moved to the downstream-blocking configuration when the next inter-media zone 322 reaches the upstream trigger location, or at any time before that.

Although the airflow control system 350, including the baffles 351 and actuators 359, were described above in the context of a specific embodiment of a printing system 300, it should be understood that other embodiments of a printing system may utilize the same airflow control system 350 or a similar airflow control system. For example, embodiments of a printing system having differently configured ink deposition assemblies or differently configured media transport devices could utilize baffles similar to the baffles 351. For example, in an embodiment that has a different number of printhead modules than the printing system 300, the same airflow control system 350 may be used except that the number of baffles 351 may be modified to match the number of printhead modules. In an embodiment that has a different number of printheads per printhead module than in the printing system 300, baffles similar to the baffles 351 may be used except that the number of baffle openings 352 may be modified to match the number of printheads. In an embodiment that has a different arrangement of the printheads than in the printing system 300, baffles similar to the baffles 351 may be used except that the arrangement of the baffle openings 352 may be changed to match that of the printheads. In embodiments that have different media transport devices, the same airflow control system 350 may be used, generally without needing any modification. Thus, the airflow control system 350 or similar versions thereof may be utilized in a variety of printing systems besides the specific printing system 300 described above. Those having ordinary skill in the art would understand various modifications of the numbers, arrangements, sizes, and configurations of baffles could be made without departing from the scope of the present disclosure.

Figure 6:
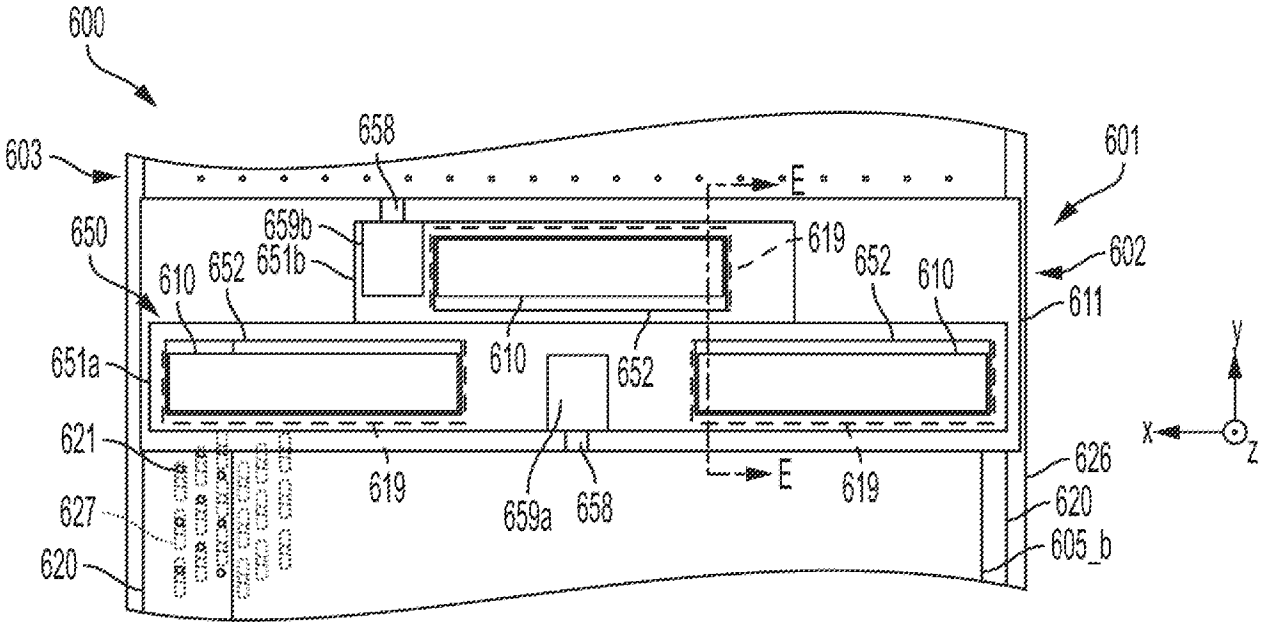
FIG. 6 is a plan view from above the printhead assembly of an embodiment of an inkjet printing system.
Figure 7A:
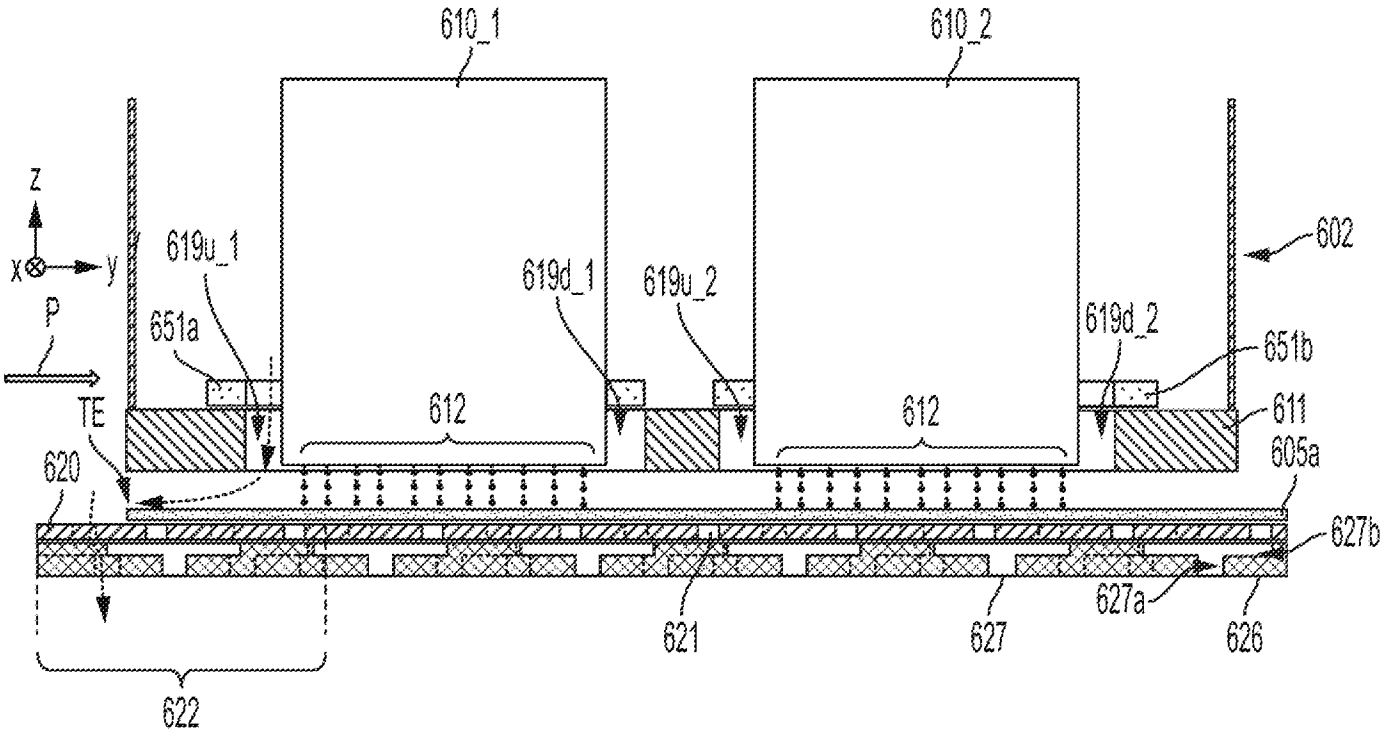
FIGS. 7A-7F are cross-sectional views of the inkjet printing system of FIG. 6, with the cross-section taken along E in FIG. 6.
Figure 7B:
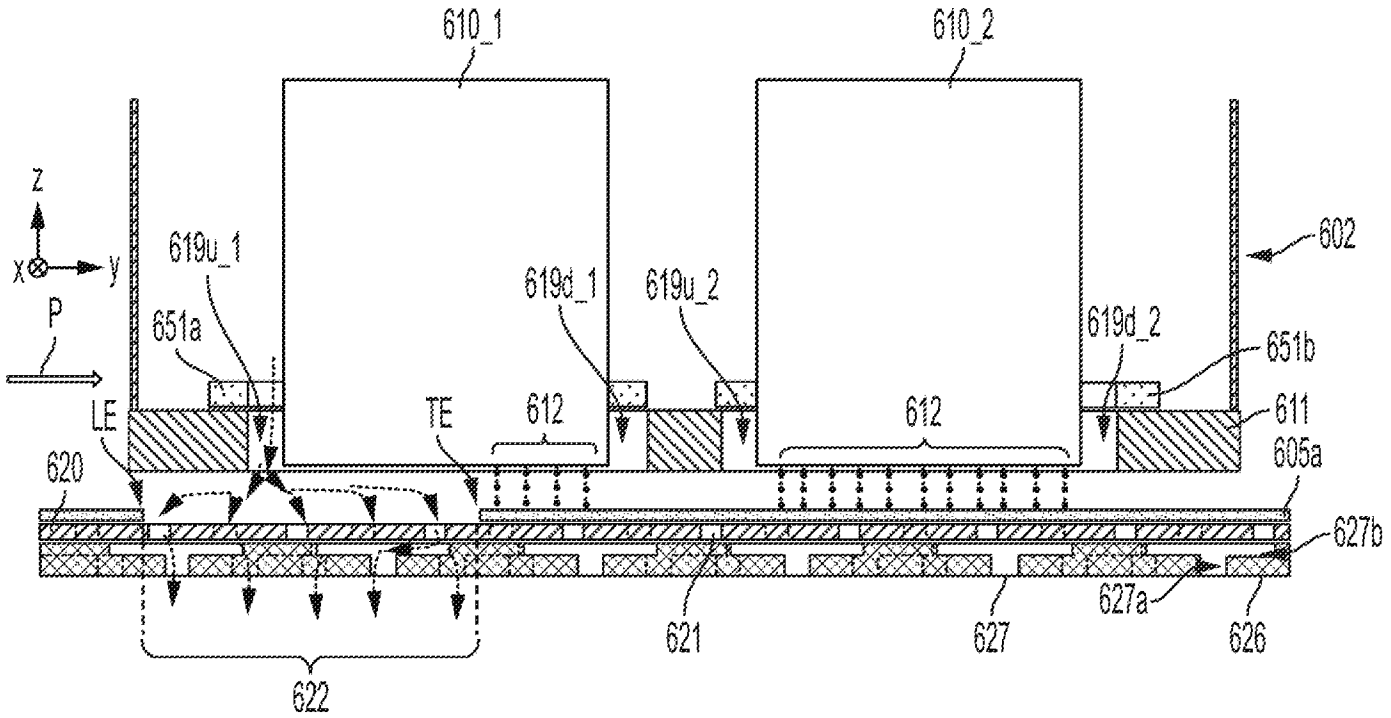
Figure 7C:
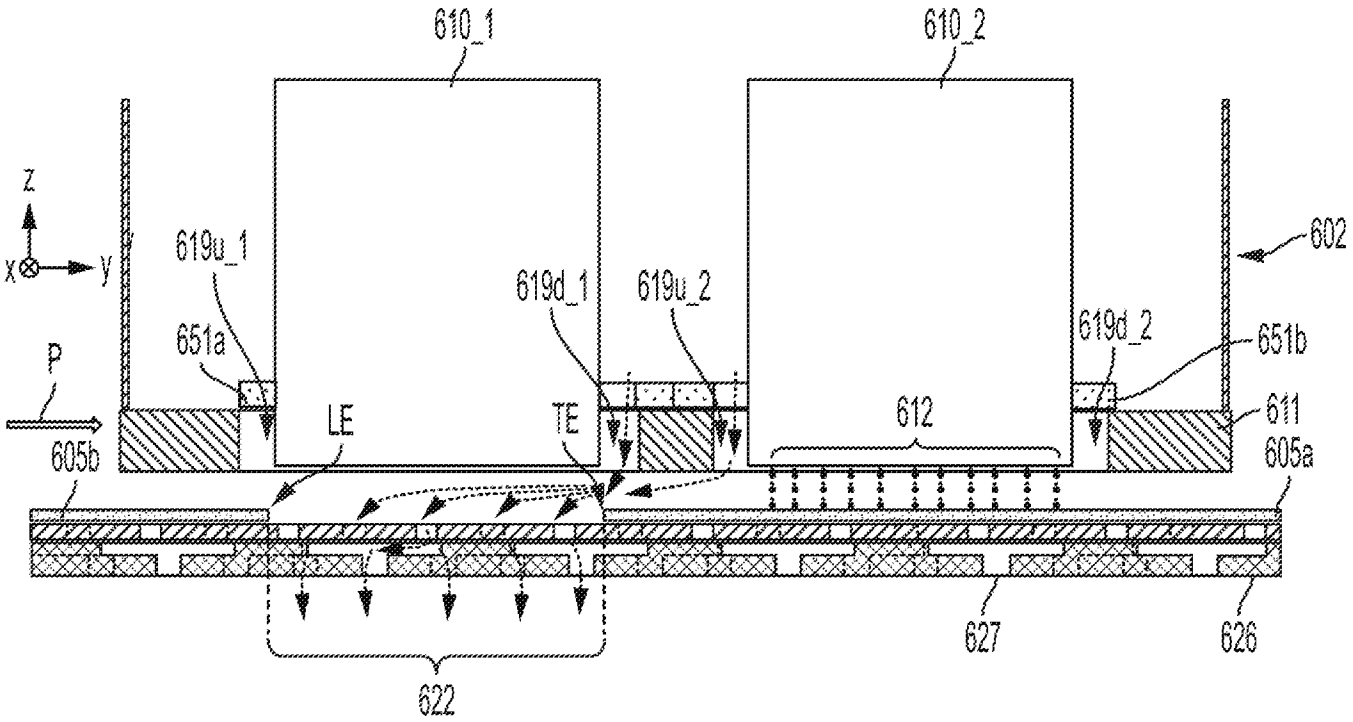
Figure 7D:
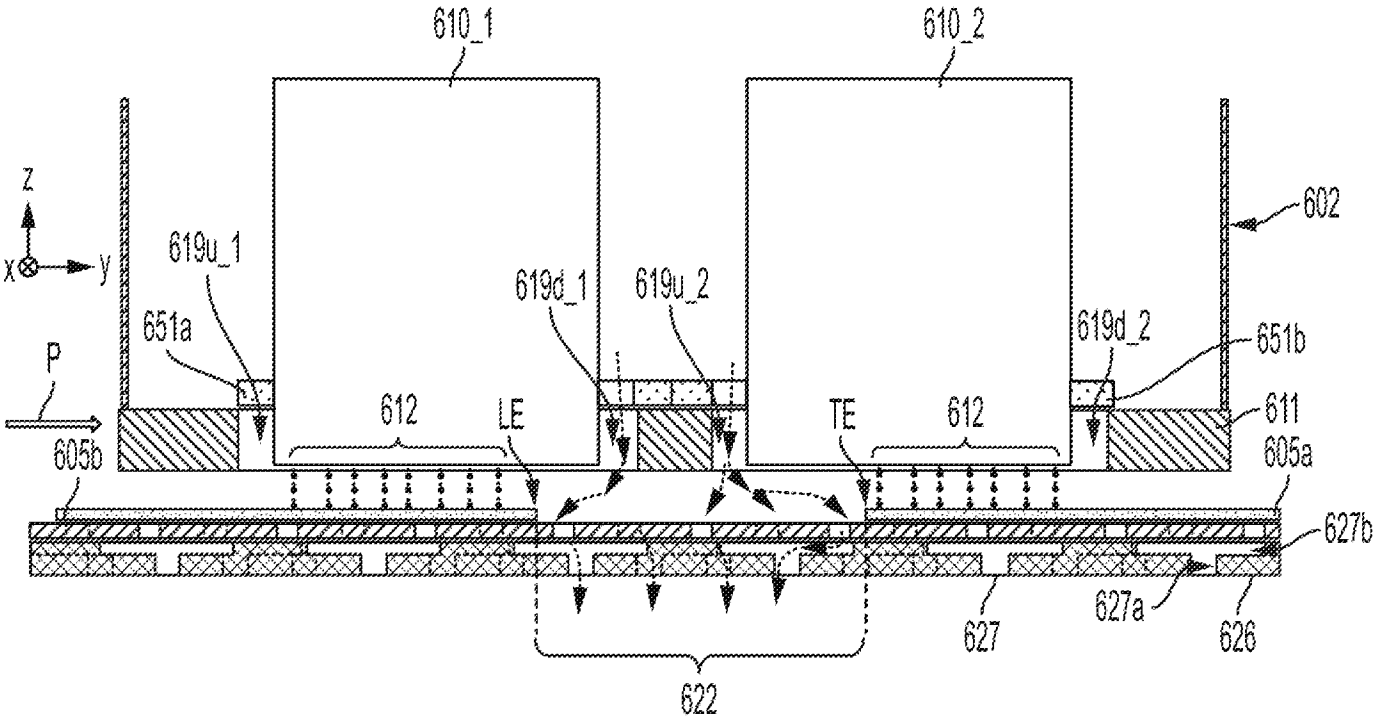
Figure 7E:
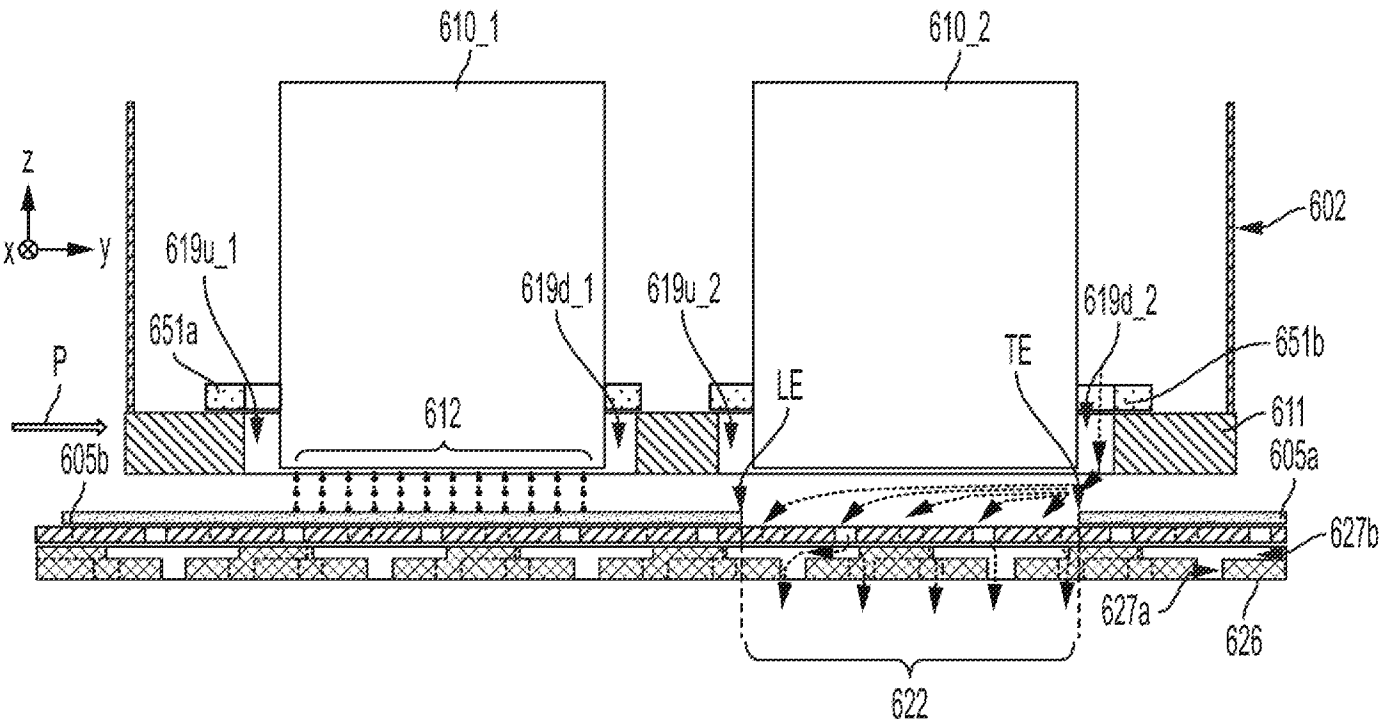
Figure 7F:
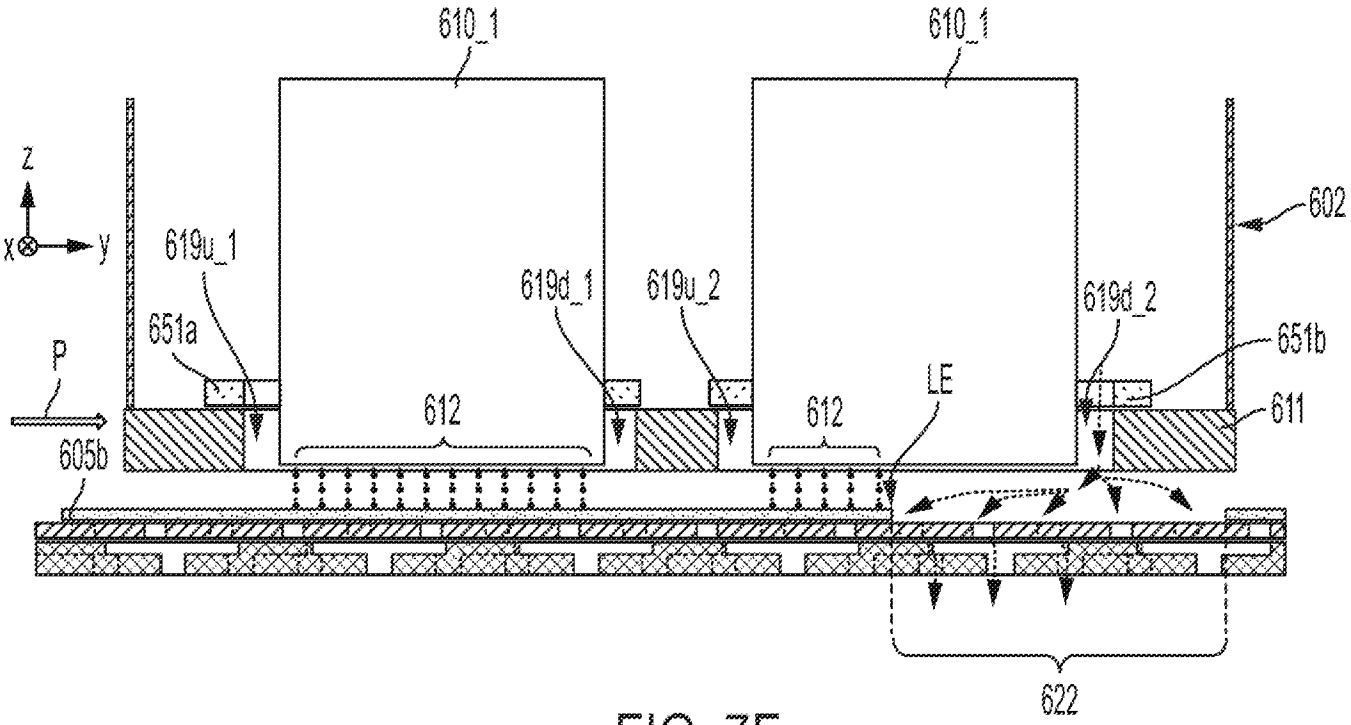

FIGS. 6-7F illustrate a printing system 600, which may be used as the printing system 100 described above with reference to FIG. 2. FIG. 6 comprises a plan view from above a portion of the printing system 600. In FIG. 6, some components that would not otherwise be visible in the view because they are positioned below other components are illustrated with dashed or dotted lines. FIGS. 7A-7F comprise cross-sections of the printing system 600 with the section taken along E in FIG. 6, with each of FIGS. 5A-5E showing a sequence of states as the print media 605*a* and 605*b* are transported past one of the printhead modules 602.

As illustrated in FIG. 6, the printing system 600 compromises an ink deposition assembly 601, a media transport device 603, and an airflow control system 650, which can be used as the ink deposition assembly 101, media transport device 103, and airflow control system 150, respectively. The printing system 600 may also comprise additional components not illustrated in FIG. 6, such as a control system (e.g., the control system 130).

The ink deposition assembly 601 comprises one or more printhead modules 602 that each have one or more printheads 610 that eject print fluid (e.g., ink) through printhead openings 619 of a carrier plate 611. The printhead modules 602, printheads 610, and carrier plate 611 can be used as the printhead modules 102, printheads 110, and carrier plate 111, respectively. Although only one printhead module 602 is illustrated to simplify the discussion, in practice multiple printhead modules 602 may be provided. In particular, the ink deposition assembly 601 may be configured similarly to the ink deposition assembly 301 described above, and thus duplicative description of its components is omitted.

The media transport device 603 comprises a vacuum platen 626 with holes 627, and a movable support surface 620 with holes 621. The media transport device 603 may be configured similarly to the media transport device 303 described above, and thus duplicative description of its components is omitted.

The airflow control system 650 comprises baffles 651 and actuators 659, which can be use as the baffles 151 and actuators 159 described above. In the airflow control system 650, multiple of the baffles 651 are provided per printhead module 602, with each baffle 651 corresponding to a different printhead 610 or group of printheads 610. Thus, in the embodiment of FIGS. 6-7F, a baffle 651*a* is associated with the two upstream printheads 610 and a baffle 651*b* is associated with the one downstream printhead 610. Although the two upstream printheads 610 share the same baffle 651*a* in this example, in other embodiments each printhead 610 could be provided with its own individual baffle 651.

The baffles 651 are structurally similar to the baffles 351 described above, except that the dimensions of the baffles 651 are different than the baffles 351 and the number of baffle openings 652 per baffle 651 is different. Specifically, the baffle 651*a* has two baffle openings 652 corresponding to the two upstream printheads 610, and the baffle 651*b* has one baffle opening corresponding to the downstream printhead 610. In some embodiments, as shown in FIG. 6, the baffle 651*b* is shorter than the baffle 651*a* in the cross-process direction because it only needs to cover one printhead opening 619. However, in other embodiments (not illustrated), the baffle 651*b* may be the same length as the baffle 651*a*.

Each baffle 651 has a corresponding actuator 659 to move it between an upstream-blocking configuration and a downstream-blocking configuration. Specifically the actuator 659*a* moves the baffle 651*a* and the actuator 659*b* moves the baffle 651*b*. The illustrated locations of the actuators 659 are examples and are not limiting—for example, the actuators 659 could be attached to the carrier plate 611 along the sides of the baffle 651*b*. The actuators 659 are similar to the actuators 359 described above, and thus duplicative description thereof is omitted.

In some embodiments, guide rails or tracks (not illustrated) may be provided to guide the baffles 651 as they are moved. In particular, because the actuator 659*b* is offset to one side of the baffle 651*b*, the actuation of the actuator 659*b* might impart some rotation to the baffle 651*b*, and thus a guide rail or track may be helpful to ensure the baffle 651*b* moves without rotating. In some embodiments, in lieu of a guide rail or track, two actuators 659*b* may be provided on either side of the baffle 651*b*, which may be actuated in concert to help ensure linear translation without rotation.

Providing multiple baffles 651 per printhead module 602 may allow for more fine-grained control over the airflow around the individual printheads 610, which might even further control (e.g., reduce the strength or occurrence of) crossflows. In particular, although the blockers 351 can be highly effective at reducing crossflows, under some circumstances some crossflows might still occur when the blockers 351 are used. For example, when the trail edge TE of the print medium 305*a* is under the upstream printhead 310 and the baffle 351 is in the downstream-blocking configuration, as in FIG. 5B, the inter-media zone 322 might be close enough to the upstream gap 319*u*_2 for some air to be pulled through the upstream gap 319*u*_2 under the printhead 310 towards the inter-media zone 322, thus creating a crossflow. In this situation, the baffle 319 is able to block the downstream gap 319*d*_1 to reduce crossflows through that gap 319*d*_1, but the baffle 319 is unable to simultaneously block the upstream gap 319*u*_2. A similar effect may happen when the lead edge LE of the print medium 305*b* is under the downstream printhead 310, as in FIG. 5E. In this situation, some air may be pulled through the downstream gap 319*d*_1 through the ink deposition region 312 towards the inter-media zone 322, thus forming a crossflow. In this state, the baffle 351 is able to block the upstream gap 319*u*_2 and thus prevent some crossflows, but the baffle 351 is not able to block both the upstream gap 319*u*_2 and the downstream gap 319*d*_1 simultaneously and thus some crossflows occur. In contrast, by using two baffles 651 that can be actuated independently, in circumstances similar to those described above the baffles 651 can block both the downstream gap 619*d*_1 and the upstream gap 619*u*_2 simultaneously, thus preventing crossflows from both gaps. This will be described in greater detail below with reference to FIGS. 7A-7F.

Similar to the baffles 351, each baffle 651 is controlled to move between upstream-blocking and downstream-blocking configurations based on the location of the inter-media zone 622. As with the baffles 351, each of the baffles 651 has an upstream trigger location and a downstream trigger location, and the baffles 351 are moved between the configurations when the inter-media zone reaches positions corresponding to those trigger locations. Specifically, when a downstream edge of the inter-media zone 622 (i.e., the trail edge TE of print medium 605*a*) reaches the upstream trigger location of a baffle 651, the baffle is placed in the downstream-blocking configuration, and when the downstream edge of the inter-media zone reaches the downstream trigger location of the baffle 651 the baffle 651 is moved to the upstream-blocking configuration. In some examples, the baffle 651*a* may also have a second downstream trigger location, and the baffle 651*a* may be returned back to the downstream-blocking configuration when the inter-media zone 622 reaches a position associated with the second downstream trigger location.

FIG. 7A illustrates the inter-media zone 622 in a position corresponding to the upstream trigger location of the baffle 651*a*. Specifically, in this position the downstream edge of the inter-media zone 622, i.e., the trail edge TE of the print medium 605*a*, is at (aligned with) the upstream trigger location of the baffle 651*a*, which in this example is the upstream edge of the carrier plate 611. Thus, the baffle 651*a* is moved to the downstream-blocking configuration. The baffle 651*b* remains in the upstream-blocking configuration because the inter-media zone 622 has not yet reached the upstream trigger location of the baffle 651*b*.

As the inter-media zone 622 continues to move downstream under the printhead 610_1, as shown in FIG. 7B, air will be drawn down through the upstream gap 619*u*_1, thus counteracting the suction from the inter-media zone 622 and reducing the strength with which air is pulled from other locations. Moreover, in contrast to the situation in FIG. 5B, when the trail edge TE is under the printhead 610_1 as in FIG. 7B the baffles 651*a*, 651*b* are able block both the downstream gap 619*d*_1 and the upstream gap 619*u*_2 and thus crossflows are prevented from flowing through either of these gaps.

FIG. 7C illustrates the inter-media zone 622 in a position corresponding to the downstream trigger location of the baffle 651*a*. Specifically, in this position the downstream edge of the inter-media zone 622, i.e., the trail edge TE of the print medium 605*a*, is at the downstream trigger location, which in this example is the downstream edge of the printhead 610_1. Thus, the baffle 651*a* is moved to the upstream-blocking configuration. In this example, the downstream trigger location of the baffle 651*a* is the same as the upstream trigger location of the baffle 652*b*. Thus, in FIG. 7C the baffle 652*b* is moved to the downstream-blocking configuration at the same time that the baffle 651*a* is moved to the upstream-blocking configuration. Although the downstream trigger location of the baffle 651*a* and the upstream trigger location of the baffle 651*b* are the same in this example, this is not limiting and in other embodiments these trigger locations could be different.

As the inter-media zone 622 continues to move downstream under the downstream printhead 610, as shown in FIG. 7D, air will be drawn down through the downstream gap 619*d*_1 and also the upstream gap 619*u*_2, thus counteracting the suction from the inter-media zone 622 and reducing the strength with which air is pulled from other locations. Moreover, in this state the upstream gap 619*u*_1 and the downstream gap 619*d*_2 are both blocked, thus crossflows are prevented from flowing through either of these gaps.

FIG. 7E illustrates the inter-media zone 622 in a position corresponding to the downstream trigger location of the baffle 651*b*. Specifically, in this position the downstream edge of the inter-media zone 622, i.e., the trail edge TE of the print medium 605*a*, is at the downstream trigger location, which in this example is the downstream edge of the printhead 610_2. Thus, the baffle 651*b* is moved to the upstream-blocking configuration. In this example, the second downstream trigger location of the baffle 651*a* is the same as the downstream trigger location of the baffle 652*b*. Thus, in FIG. 7E the baffle 652*a* is moved to the downstream-blocking configuration at the same time that the baffle 651*b* is moved to the upstream-blocking configuration. Although the second downstream trigger location of the baffle 651*a* and the downstream trigger location of the baffle 652*b* are the same in this example, this is not limiting and in other embodiments these trigger locations could be different.

As the inter-media zone 622 continues to move downstream past the printhead 610_2, as shown in FIG. 7F, air will be drawn down through the downstream gap 619*d*_2, thus counteracting the suction from the inter-media zone 622 and reducing the strength with which air is pulled from other locations. Moreover, in contrast to the situation in FIG. 5E, when the lead edge LE is under the printhead 610_2 as in FIG. 7F the baffles 651*a*, 651*b* are able block both the downstream gap 619*d*_1 and the upstream gap 619*u*_2 and thus crossflows are prevented from flowing through either of these gaps.

After the inter-media zone 622 has fully passed the printhead module 602 associated with the baffles 651, the positions of the baffles 651 become less important from the perspective of reducing crossflows, as the inter-media zone 622 will likely be too distant to induce any significant crossflows. Thus, the baffles 651 may be placed in any desired position in this state. For example, the baffles 651 may be left in their current configurations or they may be placed in their initial configurations until a next inter-media zone 622 arrives.

Although the airflow control system 650, including the baffles 651 and actuators 659, were described above in the context of a specific embodiment of a printing system 600, it should be understood that other embodiments of a printing system may utilize the same airflow control system 650 or a similar airflow control system. For example, embodiments of a printing system having differently configured ink deposition assemblies or differently configured media transport devices could utilize baffles similar to the baffles 651. For example, in an embodiment that has a different number of printhead modules than the printing system 600, the same airflow control system 650 may be used except that the number of baffles 651 may be modified based on the number of printhead modules. In an embodiment that has a different number of printheads per printhead module than in the printing system 600, baffles similar to the baffles 651 may be used except that the number of baffles 651 and/or the number of baffle openings 652 in each baffle 651 may be modified so that each printheads has one corresponding baffle opening 652. In an embodiment that has a different arrangement of the printheads than in the printing system 600, baffles similar to the baffles 651 may be used except that the arrangement of the baffle openings 652 may be changed to match that of the printheads. In embodiments that have different media transport devices, the same airflow control system 650 may be used, generally without needing any modification. Thus, the airflow control system 650 or similar versions thereof may be utilized in a variety of printing systems besides the specific printing system 600 described above.

Figure 8:
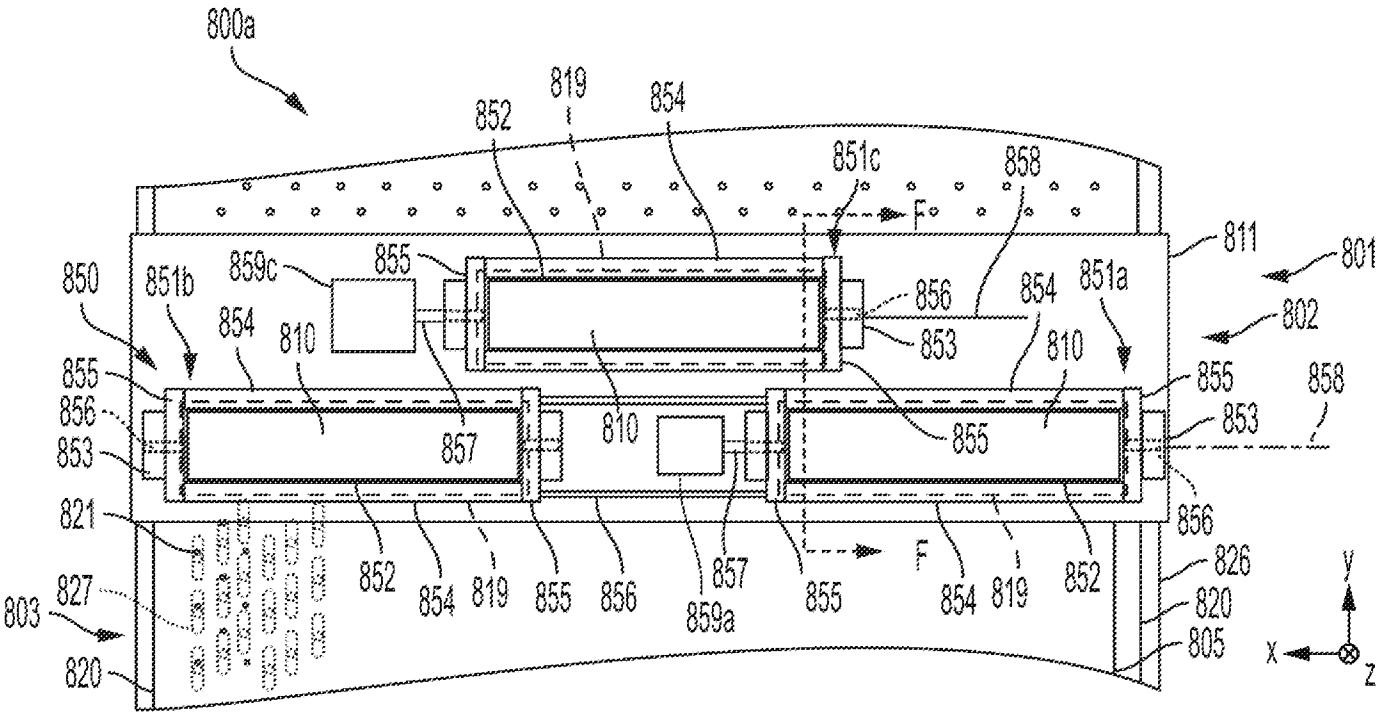
FIG. 8 is a plan view from above the printhead assembly of an embodiment of an inkjet printing system.
Figure 9:
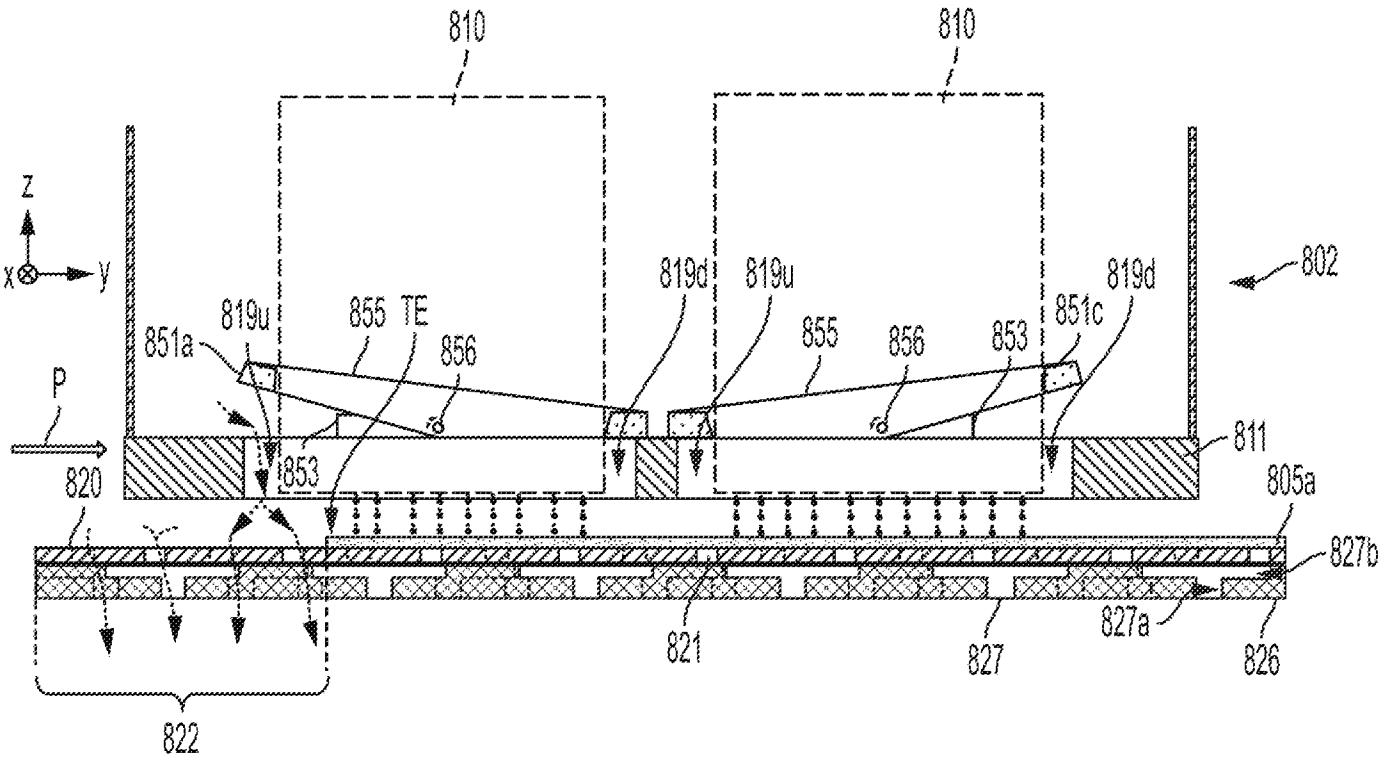
FIG. 9 is a cross-sectional view of the inkjet printing system of FIG. 6, with the cross-section taken along F in FIG. 8.

FIGS. 8 and 9 illustrate another embodiment of a printing system, i.e., printing system 800, which may be used as the printing system 100 described above with reference to FIG. 2. FIG. 8 comprises a plan view from above a portion of the printing system 800. In FIG. 8, some components that would not otherwise be visible in the view because they are positioned below other components are illustrated with dashed or dotted lines. FIG. 9 comprises a cross-section of the printing system 800 with the section taken along F in FIG. 8. In FIG. 9, the printheads 810 are made transparent, without their outline being indicated by the dotted lines, to make visible structures that would be behind the printheads 810 in the view.

As illustrated in FIG. 8, the printing system 800 compromises an ink deposition assembly 801, a media transport device 803, and an airflow control system 850, which can be used as the ink deposition assembly 101, media transport device 103, and airflow control system 150, respectively. The printing system 800 may also comprise additional components not illustrated in FIGS. 8 and 9, such as a control system (e.g., the control system 130).

The ink deposition assembly 801 comprises one or more printhead modules 802 that each have one or more printheads 810 that eject print fluid (e.g., ink) through printhead openings 819 of a carrier plate 811. The printhead modules 802, printheads 810, and carrier plate 811 can be used as the printhead modules 102, printheads 110, and carrier plate 111, respectively. Although only one printhead module 802 is illustrated to simplify the discussion, in practice multiple printhead modules 802 may be provided. In particular, the ink deposition assembly 801 may be configured similarly to the ink deposition assembly 301 described above, and thus duplicative description of its components is omitted.

The media transport device 803 comprises a vacuum platen 826 with holes 827, and a movable support surface 820 with holes 821. The media transport device 803 may be configured similarly to the media transport device 303 described above, and thus duplicative description of its components is omitted.

The airflow control system 850 comprises baffles 851 and actuators 859, which can be use as the baffles 151 and actuators 159 described above. The baffles 851 are similar to the baffles 351 and 651 in that they each comprise one or more baffle openings 852 that each correspond to one of the printheads 810. The baffles 851 differ from the baffle 351 and the baffles 651 in that the baffles 851 are moved between the upstream-blocking configuration and the downstream-blocking configuration by rotating the baffles 851, rather than by translation. The baffles 851 are arranged to rotate about corresponding axes of rotation 858 that are parallel to a cross-process direction.

The baffles 851 comprises upstream and blocking portions 854 extending in the cross-process direction and arranged on an upstream and downstream side of the each opening 852. A pair of blocking portions 854 corresponding to the same opening 852 are coupled together by a pair of rocker arms 855 extending in the process direction. Each rocker arm 855 is pivotably coupled relative to the carrier plate 811, for example by a base plate 853 which is fixed relative to the carrier plate 811 and a pivot 856 that rotatably couples the rocker arm 855 to the base plate 853. The rocker arms 855 are configured such that, when they rotate (pivot) relative to the carrier plate 811, the blocking portions 854 move up and down between blocking positions and non-blocking positions. Specifically, in the upstream-blocking configuration (see the baffle 851*c* in FIG. 9), an upstream-blocking portion 854 of the baffle 851 is against (or near) the carrier plate 811 to blocking an upstream gap 819*u*, while a downstream-blocking portion 854 of the baffle 851 is spaced a distance from (raised above) the carrier plate 811 to not block a downstream gap 819*d*. Conversely, in the downstream-blocking configuration (see the baffle 851*a* in FIG. 9), a downstream-blocking portion 854 of the baffle 851 is against (or near) the carrier plate 811 to block a downstream gap 819*d* while an upstream-blocking portion 855 of the baffle 851 is spaced some distance apart from the carrier plate 811 to not block an upstream gap 819*d*.

The baffles 851 may be driven to rotate between the upstream-blocking and downstream-blocking configurations by actuators 859. In FIG. 8, the actuators 859 are rotary actuators that drive rotation of shaft 857, with rotation of the shaft 857 driving rotation of the rocker arms 855. In other embodiments, the actuators 850 may be linear actuators that drive rotation of the shaft 857 through a linear to rotary conversion mechanism. For example, a linear actuator may be coupled to one side of the baffle 851 and configured to move that side of the baffle 851 vertically (i.e., Z-axis direction), with the pivot 856 converting this linear motion into rotation of the rocker arms 855. In the embodiment illustrated in FIG. 8, the shaft 857 is coupled to the pivot 856, or is an integral part of the same piece as the pivot 856, and the pivot 856 is fixed relative to the rocker arms 855, such that rotation of the shaft 857 causes rotation of the pivot 856 which causes rotation of the rocker arms 855.

In FIG. 8, the actuator 859*a* drives rotation of both the baffles 851*a* and 851*b*, while the actuator 859*c* drives rotation of the baffle 851*c*. To allow the actuator 859*a* to drive rotation of both baffles 851*a* and 851*b*, the baffles are coupled together by linkages 856. In some embodiments, the baffles 851*a* and 851*b* and the linkages 856 are integrally connected parts of the same continuous piece of material. In other embodiments, the baffles 851*a* and 851*b* are separately formed parts that are coupled together by the linkages 856. In still other embodiments, the linkages 856 could be omitted and an additional actuator 859 could be provided to actuate the baffle 851*b*. If the baffles 851*a* and 851*b* are driven by separate actuators 859, then the baffles 851*a* and 851*b* may be moved at the same timings as one another to the same configurations as one another, since they are both aligned in the cross-process direction.

The timings at which the baffles 851*a* and the baffle 851*c* are driven to move between the upstream-blocking configuration and the downstream-blocking configuration, as well as the effects produced by operating the baffles 851 in this manner, may be the same as those described above in relation to the baffles 651*a* and 651*b*, respectively. Accordingly, duplicative description of the actuation timings and the effects of the baffles 851 are omitted.

Although the airflow control system 850, including the baffles 851 and actuators 859, were described above in the context of a specific embodiment of a printing system 800, it should be understood that other embodiments of a printing system may utilize the same airflow control system 850 or a similar airflow control system. For example, embodiments of a printing system having differently configured ink deposition assemblies or differently configured media transport devices could utilize baffles similar to the baffles 851. For example, in an embodiment that has a different number of printhead modules than the printing system 800, the same airflow control system 850 may be used except that the number of baffles 851 may be modified based on the number of printhead modules. In an embodiment that has a different number of printheads per printhead module than in the printing system 800, baffles similar to the baffles 851 may be used except that the number of baffles 851 and/or the number of baffle openings 852 in each baffle 851 may be modified so that each printheads has one corresponding baffle opening 852. In an embodiment that has a different arrangement of the printheads than in the printing system 800, baffles similar to the baffles 851 may be used except that the arrangement of the baffle openings 852 may be changed to match that of the printheads. In embodiments that have different media transport devices, the same airflow control system 850 may be used, generally without needing any modification. Thus, the airflow control system 850 or similar versions thereof may be utilized in a variety of printing systems besides the specific printing system 800 described above. In addition, various different types of baffles described herein could be used together in the same system—for example, translatable baffles such as the baffles 351 and 651 could be used for some printheads while rotatable baffles such as the baffles 751 could be used with other printheads.

This description and the accompanying drawings that illustrate inventive aspects and embodiments should not be taken as limiting—the claims define the protected invention. Various mechanical, compositional, structural, electrical, and operational changes may be made without departing from the spirit and scope of this description and the claims. In some instances, well-known circuits, structures, and techniques have not been shown or described in detail in order not to obscure the invention. Like numbers in two or more figures represent the same or similar elements.

As used herein, "blocking" an upstream or downstream side of a printhead opening 119, 319, 619, 819 refers to positioning an object (e.g., a blocking portion of the baffle 151, 351, 651, 851) relative to the gap between the rim of the opening and a side of the printhead (e.g., upstream gap 319*u*, 619*u*, or 819*u* or a downstream gap 319*d*, 619*d*, or 819*d*) such that the object substantially covers the gap and is in sufficiently close proximity to the carrier plate and the printhead to prevent airflow through the hole. In this context, a baffle (e.g., baffle 151, 351, 751, 851) "preventing" air from flowing through the side of the printhead opening means that the baffle creates a relatively high impedance state for the side of the printhead opening such that airflow through the side of the printhead opening is significantly reduced, as compared to a completely open state (e.g., impedance is increased around tenfold or greater and/or airflow is decreased to around 10% or less of the open state). Thus, blocking the side of the printhead opening and preventing airflow does not necessarily require a hermetic seal or the strict elimination of all airflow. In some embodiments, the blockers decrease airflow through the blocked gap to no more than around 5% of the open state. In some embodiments, the blockers decrease airflow through the blocked gap to no more than around 2% of the open state. In some embodiments, the blockers decrease airflow through the blocked gap to no more than around 1% of the open state.

Further, the terminology used herein to describe aspects of the invention, such as spatial and relational terms, is chosen to aid the reader in understanding embodiments of the invention but is not intended to limit the invention. For example, spatially terms—such as "beneath", "below", "lower", "above", "upper", "inboard", "outboard", "up", "down", and the like—may be used herein to describe directions or one element's or feature's spatial relationship to another element or feature as illustrated in the figures. These spatial terms are used relative to the poses illustrated in the figures, and are not limited to a particular reference frame in the real world. Thus, for example, the direction "up" in the figures does not necessarily have to correspond to an "up" in a world reference frame (e.g., away from the Earth's surface). Furthermore, if a different reference frame is considered than the one illustrated in the figures, then the spatial terms used herein may need to be interpreted differently in that different reference frame. For example, the direction referred to as "up" in relation to one of the figures may correspond to a direction that is called "down" in relation to a different reference frame that is rotated 180 degrees from the figure's reference frame. As another example, if a device is turned over 180 degrees in a world reference frame as compared to how it was illustrated in the figures, then an item described herein as being "above" or "over" a second item in relation to the Figures would be "below" or "beneath" the second item in relation to the world reference frame. Thus, the same spatial relationship or direction can be described using different spatial terms depending on which reference frame is being considered. Moreover, the poses of items illustrated in the figure are chosen for convenience of illustration and description, but in an implementation in practice the items may be posed differently.

The term "process direction" refers to a direction that is parallel to and pointed in the same direction as an axis along which the print media moves as is transported through the deposition region of the ink deposition assembly. Thus, the process direction is a direction parallel to the y-axis in the Figures and pointing in a positive y-axis direction.

The term "cross-process direction" refers to a direction perpendicular to the process direction and parallel to the movable support surface. At any given point, there are two cross-process directions pointing in opposite directions, i.e., an "inboard" cross-process direction and an "outboard" cross-process direction. Thus, considering the reference frames illustrated in the Figures, a cross-process direction is any direction parallel to the x-axis, including directions pointing in a positive or negative direction along the x-axis. References herein to a "cross-process direction" should be understood as referring generally to any of the cross-process directions, rather than to one specific cross-process direction, unless indicated otherwise by the context. Thus, for example, the statement "the valve is movable in a cross-process direction" means that the valve can move in an inboard direction, outboard direction, or both directions.

The terms "upstream" and "downstream" may refer to directions parallel to a process direction, with "downstream" referring to a direction pointing in the same direction as the process direction (i.e., the direction the print media are transported through the ink deposition assembly) and "upstream" referring to a direction pointing opposite the process direction. In the Figures, "upstream" corresponds to a negative y-axis direction, while "downstream" corresponds to a positive y-axis direction. The terms "upstream" and "downstream" may also be used to refer to a relative location of element, with an "upstream" element being displaced in an upstream direction relative to a reference point and a "downstream" element being displaced in a downstream direction relative to a reference point. In other words, an "upstream" element is closer to the beginning of the path the print media takes as it is transported through the ink deposition assembly (e.g., the location where the print media joins the movable support surface) than is some other reference element. Conversely, a "downstream" element is closer to the end of the path (e.g., the location where the print media leaves the support surface) than is some other reference element. The reference point of the other element to which the "upstream" or "downstream" element is compared may be explicitly stated (e.g., "an upstream side of a printhead"), or it may be inferred from the context.

The terms "inboard" and "outboard" refer to cross-process directions, with "inboard" referring to one to cross-process direction and "outboard" referring to a cross-process direction opposite to "inboard." In the Figures, "inboard" corresponds to a positive x-axis direction, while "outboard" corresponds to a negative x-axis direction. The terms "inboard" and "outboard" also refer to relative locations, with an "inboard" element being displaced in an inboard direction relative to a reference point and with an "outboard" element being displaced in an outboard direction relative to a reference point. The reference point may be explicitly stated (e.g., "an inboard side of a printhead"), or it may be inferred from the context.

The term "vertical" refers to a direction perpendicular to the movable support surface in the deposition region. At any given point, there are two vertical directions pointing in opposite directions, i.e., an "upward" direction and an "downward" direction. Thus, considering the reference frames illustrated in the Figures, a vertical direction is any direction parallel to the z-axis, including directions pointing in a positive z-axis direction ("up") or negative z-axis direction ("down").

The term "horizontal" refers to a direction parallel to the movable support surface in the deposition region (or tangent to the movable support surface in the deposition region, if the movable support surface is not flat in the deposition region). Horizontal directions include the process direction and cross-process directions.

The term "vacuum" has various meanings in various contexts, ranging from a strict meaning of a space devoid of all matter to a more generic meaning of a relatively low pressure state. Herein, the term "vacuum" is used in the generic sense, and should be understood as referring broadly to a state or environment in which the air pressure is lower than that of some reference pressure, such as ambient or atmospheric pressure. The amount by which the pressure of the vacuum environment should be lower than that of the reference pressure to be considered a "vacuum" is not limited and may be a small amount or a large amount. Thus, "vacuum" as used herein may include, but is not limited to, states that might be considered a "vacuum" under stricter senses of the term.

The term "air" has various meanings in various contexts, ranging from a strict meaning of the atmosphere of the Earth (or a mixture of gases whose composition is similar to that of the atmosphere of the Earth), to a more generic meaning of any gas or mixture of gases. Herein, the term "air" is used in the generic sense, and should be understood as referring broadly to any gas or mixture of gases. This may include, but is not limited to, the atmosphere of the Earth, an inert gas such as one of the Noble gases (e.g., Helium, Neon, Argon, etc.), Nitrogen ($N_2$) gas, or any other desired gas or mixture of gases.

In addition, the singular forms "a", "an", and "the" are intended to include the plural forms as well, unless the context indicates otherwise. And, the terms "comprises", "comprising", "includes", and the like specify the presence of stated features, steps, operations, elements, and/or components but do not preclude the presence or addition of one or more other features, steps, operations, elements, components, and/or groups.

Components described as coupled may be electrically or mechanically directly coupled, or they may be indirectly coupled via one or more intermediate components, unless specifically noted otherwise.

Mathematical and geometric terms are not necessarily intended to be used in accordance with their strict definitions unless the context of the description indicates otherwise, because a person having ordinary skill in the art would understand that, for example, a substantially similar element that functions in a substantially similar way could easily fall within the scope of a descriptive term even though the term also has a strict definition.

Unless otherwise noted herein or implied by the context, terms such as "significantly" when used to describe a degree of change or difference (e.g., significantly reduced, significantly increased, significantly more, significantly less, etc.) should be interpreted according to the conventions of the relevant art and in view of the relevant context. Absent any such convention, the terms may be understood as implying at least a ±10% change or difference.

Elements and their associated aspects that are described in detail with reference to one embodiment may, whenever practical, be included in other embodiments in which they are not specifically shown or described. For example, if an element is described in detail with reference to one embodiment and is not described with reference to a second embodiment, the element may nevertheless be claimed as included in the second embodiment.

It is to be understood that the particular examples and embodiments set forth herein are non-limiting, and modifications to structure, dimensions, materials, and methodologies may be made without departing from the scope of the present teachings.

Other embodiments in accordance with the present disclosure will be apparent to those skilled in the art from consideration of the specification and practice of the inventions disclosed herein. It is intended that the specification and embodiments be considered as exemplary only, with the following claims being entitled to their fullest breadth, including equivalents, under the applicable law.

What is claimed is:

1. A printing system, comprising:

an ink deposition assembly comprising a carrier plate and a printhead arranged to eject a print fluid through a printhead opening in the carrier plate to a deposition region of the ink deposition assembly;

a media transport device comprising a movable support surface, the media transport device configured to hold a print medium against the movable support surface by vacuum suction through holes in the media transport device and transport the print medium along a process direction though the deposition region; and an airflow control system comprising:

a baffle that is movable between an upstream-blocking configuration and a downstream-blocking configuration; and an actuator configured to move the baffle between the upstream-blocking configuration and the downstream-blocking configuration, wherein in the upstream-blocking configuration the baffle blocks airflow through an upstream side of the printhead opening while allowing airflow through a downstream side of the printhead opening, upstream and downstream being defined based on the process direction, and in the downstream-blocking configuration the baffle blocks airflow through the downstream side of the printhead opening while allowing airflow through the upstream side of the printhead opening.

2. The printing system of claim 1, comprising:

a controller configured to cause the actuator to selectively move the baffle between upstream-blocking configuration and the downstream-blocking configuration based on a position of an inter-media zone between adjacent print media held against the movable support surface.

3. The printing system of claim 2, wherein the controller is configured to cause the actuator to move the baffle such that:

the baffle is in the downstream-blocking configuration when a downstream edge of the inter-media zone reaches a first location associated with the baffle; and the baffle is in the upstream-blocking configuration when the downstream edge of the inter-media zone reaches a second location associated with the baffle.

4. The printing system of claim 3, wherein the first location associated with the baffle corresponds to any of: an upstream edge of the carrier plate, an upstream edge of the printhead opening, an upstream edge of the printhead.

5. The printing system of claim 3, wherein the second location associated with the baffle corresponds to a downstream edge of the printhead or a downstream edge of the printhead opening.

6. The printing system of claim 1, comprising:

a controller configured to cause the actuator to selectively move the baffle to:

the upstream-blocking configuration while a lead edge of the print medium is under the printhead; and the downstream-blocking configuration while a trail edge of the print medium is under the printhead.

7. The printing system of claim 1, wherein the ink deposition assembly comprises a second printhead arranged to eject print fluid through a second printhead opening in the carrier plate, wherein the airflow control system comprises:

a second baffle that is movable between an upstream-blocking configuration and a downstream-blocking configuration, and a second actuator configured to move the second baffle between the upstream-blocking configuration and the downstream-blocking configuration, wherein in the upstream-blocking configuration the second baffle blocks airflow through an upstream side of the second printhead opening while allowing airflow through a downstream side of the second printhead opening, and in the downstream-blocking configuration the second baffle blocks airflow through the downstream side of the second printhead opening while allowing airflow through the upstream side of the second printhead opening.

8. The printing system of claim 7, further comprising:

a controller configured to cause the actuator and the second actuator to selectively and independently move the baffle and the second baffle between the upstream-blocking configuration and the downstream-blocking configuration based on a position of an inter-media zone between adjacent print media held against the movable support surface.

9. The printing system of claim 7, further comprising:

a controller configured to cause the actuator to selectively move the baffle to:

the upstream-blocking configuration while a lead edge of the print medium is under the printhead; and the downstream-blocking configuration while a trail edge of the print medium is under the printhead; and wherein the controller is configured to cause the second actuator to selectively move the second baffle to:

the upstream-blocking configuration while the lead edge of the print medium is under the second printhead; and the downstream-blocking configuration while the trail edge of the print medium is under the second printhead.

10. The printing system of claim 7, wherein the baffle and the second baffle are both arranged to move in translation along a process direction while moving between the upstream-blocking configuration and the downstream-blocking configuration.

11. The printing system of claim 7, wherein the baffle and the second baffle are both arranged to rotate about respective axes extending parallel to a cross-process direction while moving between the upstream-blocking configuration and the downstream-blocking configuration.

12. The printing system of claim 1, wherein the baffle is arranged to move in translation along a process direction while moving between the upstream-blocking configuration and the downstream-blocking configuration.

13. The printing system of claim 1, wherein the baffle is arranged to rotate about an axis parallel to a cross-process direction while moving between the upstream-blocking configuration and the downstream-blocking configuration.

14. The printing system of claim 13, wherein the baffle comprises:

blocking portions arranged upstream and downstream of the printhead, the blocking portions blocking airflow through the upstream side of the printhead opening and the downstream side of the printhead opening, respectively;

rocker arms coupling the blocking portions together; and pivots that pivotably couple the rocker arms to the carrier plate.

15. The printing system of claim 1, wherein the media transport device comprises a vacuum platen that supports the movable support surface, the holes extending through the vacuum platen; and wherein the movable support surface comprises a belt configured to move over a surface of the vacuum platen.

16. A method, comprising:

transporting a print medium in a process direction through a deposition region of a printhead of printing system, wherein the print medium is held during the transporting against a moving support surface of a media transport device via vacuum suction through holes in the media transport device;

ejecting print fluid from the printhead through a printhead opening in a carrier plate to deposit the print fluid to the print medium in the deposition region; and controlling an airflow control system to selectively block an upstream side of the printhead opening and a downstream side of the printhead opening by moving a baffle between an upstream-blocking configuration in which the baffle blocks the upstream side of the printhead opening and a downstream-blocking configuration in which the baffle blocks a downstream side of the printhead opening, wherein upstream and downstream are defined based on the process direction.

17. The method of claim 16, wherein selectively blocking the upstream side of the printhead opening and the downstream side of the printhead opening comprises moving the baffle between the upstream-blocking and downstream-blocking configurations based on a position of an inter-media zone between adjacent print media held against the moving support surface.

18. The method of claim 16, wherein selectively blocking the upstream side of the printhead opening and the downstream side of the printhead opening comprises:

placing the baffle in the upstream-blocking configuration at least while a lead edge of the print medium is under the printhead; and placing the baffle in the downstream-blocking configuration at least while a trail edge of the print medium is under the printhead.

19. The method of claim 16, wherein moving the baffle between the upstream-blocking configuration and the downstream-blocking configuration comprises causing an actuator to move the baffle in translation along a process direction.

20. The method of claim 16, wherein moving the baffle between the upstream-blocking configuration and the downstream-blocking configuration comprises causing an actuator to rotate the baffle about an axis parallel to a cross-process direction.

* * * * *